US009669639B2

(12) United States Patent
Nagasawa et al.

(10) Patent No.: US 9,669,639 B2
(45) Date of Patent: Jun. 6, 2017

(54) POST-PROCESSING LIQUID APPLICATION DEVICE, IMAGE FORMING SYSTEM INCLUDING POST-PROCESSING LIQUID APPLICATION DEVICE, AND POST-PROCESSING LIQUID APPLICATION METHOD

(71) Applicants: Satoru Nagasawa, Kanagawa (JP); Yoshinari Suzuki, Kanagawa (JP)

(72) Inventors: Satoru Nagasawa, Kanagawa (JP); Yoshinari Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/232,957

(22) Filed: Aug. 10, 2016

(65) Prior Publication Data

US 2017/0057253 A1 Mar. 2, 2017

(30) Foreign Application Priority Data

Aug. 24, 2015 (JP) ..... 2015-165268
Jul. 15, 2016 (JP) ..... 2016-140882

(51) Int. Cl.

| | |
|---|---|
| ***B41J 11/00*** | (2006.01) |
| ***B41J 2/21*** | (2006.01) |
| ***B41M 5/00*** | (2006.01) |
| ***B41M 7/00*** | (2006.01) |

(52) U.S. Cl.

CPC ..... *B41J 11/0015* (2013.01); *B41J 2/2114* (2013.01); *B41M 5/0011* (2013.01); *B41M 7/0027* (2013.01)

(58) Field of Classification Search

CPC ... B41J 2/2114; B41J 11/0015; B41M 5/0011; B41M 7/0027

See application file for complete search history.

(56) References Cited

U.S. PATENT DOCUMENTS

| | | | |
|---|---|---|---|
| 7,651,213 | B2 | 1/2010 | Konno et al. |
| 8,864,299 | B2 | 10/2014 | Suzuki et al. |
| 8,967,753 | B2 | 3/2015 | Suzuki et al. |
| 9,254,683 | B2 | 2/2016 | Akiyama et al. |
| 9,272,539 | B2 | 3/2016 | Yasu et al. |
| 9,290,005 | B1 | 3/2016 | Akiyama et al. |

(Continued)

FOREIGN PATENT DOCUMENTS

| | | |
|---|---|---|
| JP | 2007-055257 | 3/2007 |
| JP | 2014-176997 | 9/2014 |

*Primary Examiner* — Julian Huffman
(74) *Attorney, Agent, or Firm* — IPUSA, PLLC

(57) ABSTRACT

A post-processing liquid application device includes an ejecting head that ejects a post-processing liquid in a specific ejection pattern on a recording medium after ink has been attached thereto to form a character and/or an image based on image information, and a control unit that selects the specific ejection pattern based on a coverage rate calculated from the image information. When the coverage rate is low, the control unit selects a first ejection pattern for ejecting the post-processing liquid on a printed portion of a print region of the recording medium or ejecting the post-processing liquid on the printed portion and a surrounding portion thereof. When the coverage rate is high, the control unit selects a second ejection pattern for ejecting the post-processing liquid over the entire surface of the print region of the recording medium.

11 Claims, 11 Drawing Sheets

(56) References Cited

U.S. PATENT DOCUMENTS

| | | | | |
|---|---|---|---|---|
| 2004/0061760 | A1* | 4/2004 | Yano | H04N 1/6022 347/102 |
| 2009/0073203 | A1* | 3/2009 | Takekoshi | B41J 2/2114 347/9 |
| 2009/0073204 | A1* | 3/2009 | Takekoshi | B41J 2/2114 347/9 |
| 2011/0001779 | A1* | 1/2011 | Kida | B41J 2/2114 347/42 |
| 2013/0293629 | A1* | 11/2013 | Niino | B41J 2/01 347/21 |
| 2013/0293645 | A1* | 11/2013 | Yasu | B41J 2/2114 347/101 |
| 2014/0192121 | A1* | 7/2014 | Bannai | B41J 2/2114 347/101 |
| 2014/0232783 | A1* | 8/2014 | del Rio | B41M 5/0017 347/21 |
| 2015/0056423 | A1 | 2/2015 | Yasu et al. | |
| 2016/0136975 | A1 | 5/2016 | Yasu et al. | |

* cited by examiner

POST-PROCESSING LIQUID APPLICATION DEVICE, IMAGE FORMING SYSTEM INCLUDING POST-PROCESSING LIQUID APPLICATION DEVICE, AND POST-PROCESSING LIQUID APPLICATION METHOD

CROSS-REFERENCE TO RELATED APPLICATIONS

The present application claims priority under 35 U.S.C. §119 to Japanese Patent Application No. 2015-165268 filed on Aug. 24, 2015, and Japanese Patent Application No. 2016-140882 filed on Jul. 15, 2016, the entire contents of which are incorporated herein by reference.

BACKGROUND OF THE INVENTION

1. Field of the Invention

The present invention relates to a post-processing liquid application device, an image forming system including a post-processing liquid application device, and a post-processing liquid application method.

2. Description of the Related Art

Techniques are known for applying a post-processing liquid (protector coating liquid) on a print medium after printing an object on the print medium using KCMY ink in order to improve fixation (abrasion resistance) of the printed object. Also, apparatuses are known for applying the post-processing liquid uniformly over the entire surface of a page regardless of the coverage rate representing the ratio of the area of a page portion covered with ink to the total area of the page (see, e.g., Japanese Unexamined Patent Publication No. 2007-055257).

However, the amount of post-processing liquid applied is desirably reduced in order to reduce the cost per page (CPP) and promote rapid drying. In this respect, techniques are known for partially applying the post-processing liquid on a printed portion of a print medium (e.g., portion to which ink is attached to form a character or an image) without considering the coverage rate. In such techniques, the amount of post-processing liquid to be applied may be determined based on the image forming speed (see, e.g., Japanese Unexamined Patent Publication No. 2014-176997).

Note that in the case of partially applying the post-processing liquid only on a printed portion of a print medium, the friction coefficient of a portion of the print medium upon being rubbed against another print medium is higher when the portion does not have the post-processing liquid applied thereon as compared with the friction coefficient when portions both having the post-processing liquid applied thereon rub against one another. Thus, the abrasion resistance of the printed portion may be degraded. Accordingly, in order to maintain an abrasion resistance equivalent to that achieved when full-page application of the post-processing liquid is implemented, the amount of post-processing liquid applied per unit area has to be increased at the portion where the post-processing liquid is applied.

SUMMARY OF THE INVENTION

According to one embodiment of the present invention, a post-processing liquid application device is provided that includes an ejecting head configured to eject a post-processing liquid in a specific ejection pattern on a recording medium after ink has been attached to the recording medium to form a character and/or an image generated based on image information on the recording medium, and a control unit configured to select the specific ejection pattern of the post-processing liquid to be ejected by the ejecting head from a plurality of ejection patterns based on a coverage rate calculated from the image information. When the control unit determines that the coverage rate is low, the control unit selects, as the specific ejection pattern, a first ejection pattern for ejecting the post-processing liquid on a printed portion of a print region of the recording medium or ejecting the post-processing liquid on the printed portion and a surrounding portion of the printed portion to which the ink forming the character and/or the image is attached. When the control unit determines that the coverage rate is high, the control unit selects, as the specific ejection pattern, a second ejection pattern for ejecting the post-processing liquid over the entire surface of the print region of the recording medium.

DESCRIPTION OF THE EMBODIMENTS

One aspect of the present invention is directed to providing a post-processing liquid application device that is capable of preventing problems caused by poor drying of the post-processing liquid, such as picking and sticking, that adversely affect printing quality and reducing costs associated with applying the post-processing liquid.

In the following, embodiments of the present invention are described with reference to the accompanying drawings.

An image forming apparatus (image forming system) 100 according to an embodiment of the present invention is described below. Note that although an image forming apparatus having ejecting heads (recording heads, print heads, ink heads) of the four colors of black (K), cyan (C), magenta (M), and yellow (Y) is described below as an embodiment of the present invention, the scope of the present invention is not limited to an image forming apparatus having the above ejecting heads. For example, the scope of the present invention may encompass an image forming apparatus additionally having ejecting heads of green (G), red (R), light cyan (LC), and/or other colors, and an image forming apparatus only having an ejecting head of black (K). In the following descriptions, it is assumed that Y, C, M, and K respectively represent the colors yellow, cyan, magenta, and black.

Also, although a continuous sheet arranged into a rolled sheet (hereinafter referred to as "rolled sheet Md") is used as a recording medium (hereinafter referred to as "print medium") in the embodiment described below, the print medium that can be used by an image forming apparatus according to the present invention is not limited to a rolled sheet. That is, the image forming apparatus according to the present invention may use cut sheets as the print medium, for example. Examples of print media that can be used by the image forming apparatus according to the present invention include standard paper, high quality paper, thick paper, thin paper, a cut sheet, a rolled sheet, an OHP sheet, a synthetic resin film, a metallic thin film, and other media that is capable of forming an image with ink.

Note that in the present descriptions, a rolled sheet refers to a continuous sheet of paper that is longer than standard size paper. The rolled sheet may be a continuous sheet of paper with perforations formed at predetermined intervals or a continuous sheet of paper without perforations. In the case where the rolled sheet has perforations formed thereon, a page may refer to a region having boundaries defined by adjacent lines of perforations that are formed at predetermined intervals, for example. The region forming a page of a rolled sheet is described in detail below.

(Image Forming Apparatus Configuration)

Figure 1:
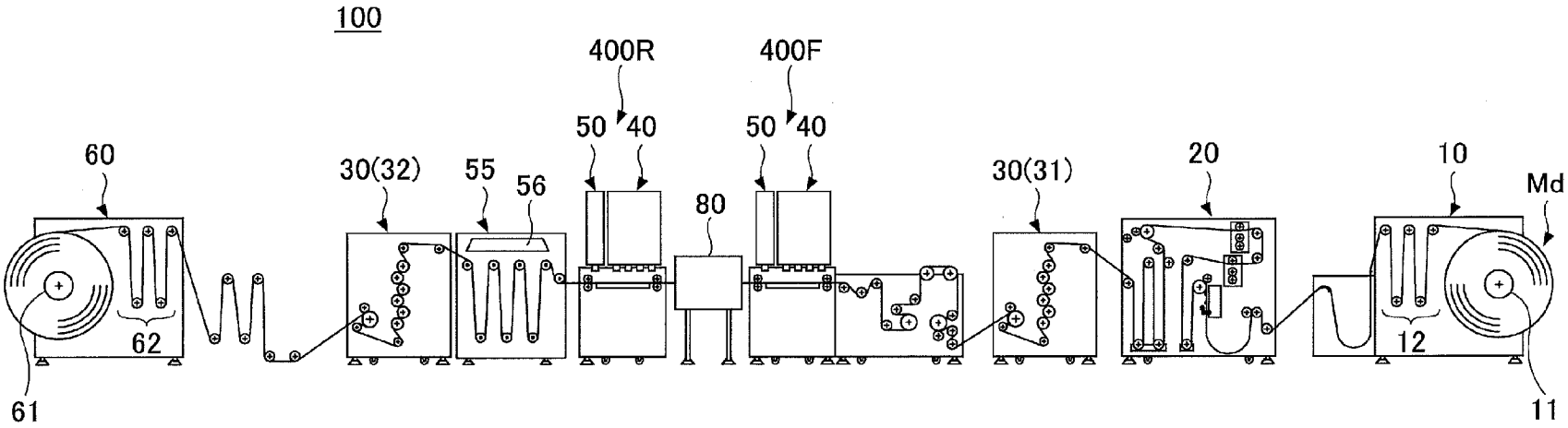
FIG. 1 is a schematic side view of an image forming apparatus according to an embodiment of the present invention.

As illustrated in FIG. 1, the image forming apparatus 100 according to the present embodiment includes a conveying unit 10, a pre-processing liquid applying unit 20, a drying unit 30 including a pre-processing liquid drying unit 31 and a post-processing liquid drying unit 32, an image forming unit 40, a post-processing liquid applying unit 50, a penetration unit 55, and a discharge unit 60.

The conveying unit 10 conveys the rolled sheet Md (print medium) that is loaded in the image forming apparatus 100. The pre-processing liquid applying unit 20 applies a pre-processing liquid (performs pre-processing) on the rolled sheet Md that has been conveyed by the conveying unit 10. The pre-processing liquid drying unit 31 of the drying unit 30 dries the rolled sheet Md that has been subjected to pre-processing.

The image forming unit 40 forms an image on a surface of the rolled sheet Md. The post-processing liquid applying unit 50 ejects a post-processing liquid (performs post-processing) on the surface of the rolled sheet Md on which an image has been formed by the image forming unit 40.

The image forming apparatus 100 includes two printer apparatuses 400F and 400R each including the image forming apparatus 40 and the post-processing liquid applying unit 50. Further, a turn bar 80 is arranged in between the two printer apparatuses 400F and 400R. The turn bar 80 may use a plurality of bars and rollers to turn the rolled sheet Md upside down, for example. The printer apparatus 400F provided at the upstream side after the pre-processing liquid drying unit 31 functions as a front side printing apparatus for printing an image on a front side of the rolled sheet Md, and the printer apparatus 400R provided at the downstream side functions as a rear side printing apparatus for printing an image on a rear side of the rolled sheet Md. By arranging the turn bar 80 between the printer apparatuses 400F and 400R, dual side printing of the rolled sheet Md may be possible.

The penetration unit 50 causes liquid droplets to penetrate the rolled sheet Md. The post-processing liquid drying unit 32 dries liquid droplets (i.e., ink and post-processing liquid) deposited on the rolled sheet Md. The discharge unit 60 discharges (or rolls up) the rolled sheet Md that has been subjected to post-processing. Further, the image forming apparatus 100 includes a control unit 70 for controlling operations of the image forming apparatus 100 (see FIG. 5).

In the following, the above components of the image forming apparatus 100 are described in greater detail. Note that in some embodiments, the image forming apparatus 100 may not include one or more of the pre-processing liquid applying unit 20, the drying unit 30 (31, 32), and/or the penetration unit 55.

(Conveying Unit Configuration)

The conveying unit 10 conveys a print medium to the pre-processing unit 20. In the present embodiment, the conveying unit 10 includes a paper feeding unit 11 and a plurality of conveyance rollers 12. The conveying unit 10 moves the rolled sheet Md that is rolled onto a sheet feeding roller of the sheet feeding unit 11, and conveys the rolled sheet Md to the pre-processing unit 20 using the conveyance rollers 12.

(Pre-Processing Liquid Applying Unit Configuration)

The pre-processing liquid applying unit 20 performs pre-processing on a print medium before an image is formed thereon by the image processing unit 40. In the present embodiment, the pre-processing unit 20 performs pre-processing by applying the pre-processing liquid on the surface of the rolled sheet Md that has been conveyed to the pre-processing unit 20 by the conveying unit 10.

Note that pre-processing refers to a process of uniformly applying the pre-processing liquid onto the surface of the rolled sheet Md (print medium). In this way, even when a print medium other than that dedicated for inkjet printing is used to form an image, for example, the image forming apparatus 100 may use the pre-processing liquid applying unit 20 to apply the pre-processing liquid on the surface of the print medium such that ink may be condensed when an image is formed on the print medium.

(Pre-Processing Liquid Drying Unit)

The drying unit 30 dries the print medium by heating the print medium, for example. In the present embodiment, the drying unit 30 includes the pre-processing liquid drying unit 31 for drying the rolled sheet Md that has been subjected to pre-processing by the pre-processing liquid applying unit 20, and the post-processing liquid drying unit 32 for drying the rolled sheet Md that has been subjected to post-processing by the post-processing liquid applying unit 50.

The pre-processing liquid drying unit 31 may heat a plurality of heat rollers to about 80° C. to 100° C., for example, and bring the rear side of the rolled sheet Md in contact with the heat rollers. Note that in some embodiments, a warm air heating mechanism may be provided in the drying unit 30 similar to a heating unit (warm air heater) 56 having a trapezoidal shape that is arranged at the upper side of the penetration unit 55 in FIG. 1, for example. In this way, the pre-processing liquid drying unit 31 may be able to evaporate moisture (solvent) in the pre-processing liquid and dry the rolled sheet Md.

(Image Forming Unit Configuration)

The image forming unit 40 forms an image on a print medium. In the present embodiment, the image forming unit 40 ejects droplets of liquid (ink) to form an image on the surface of the rolled sheet Md that has been dried by the pre-processing liquid drying unit 31.

Figure 2A:
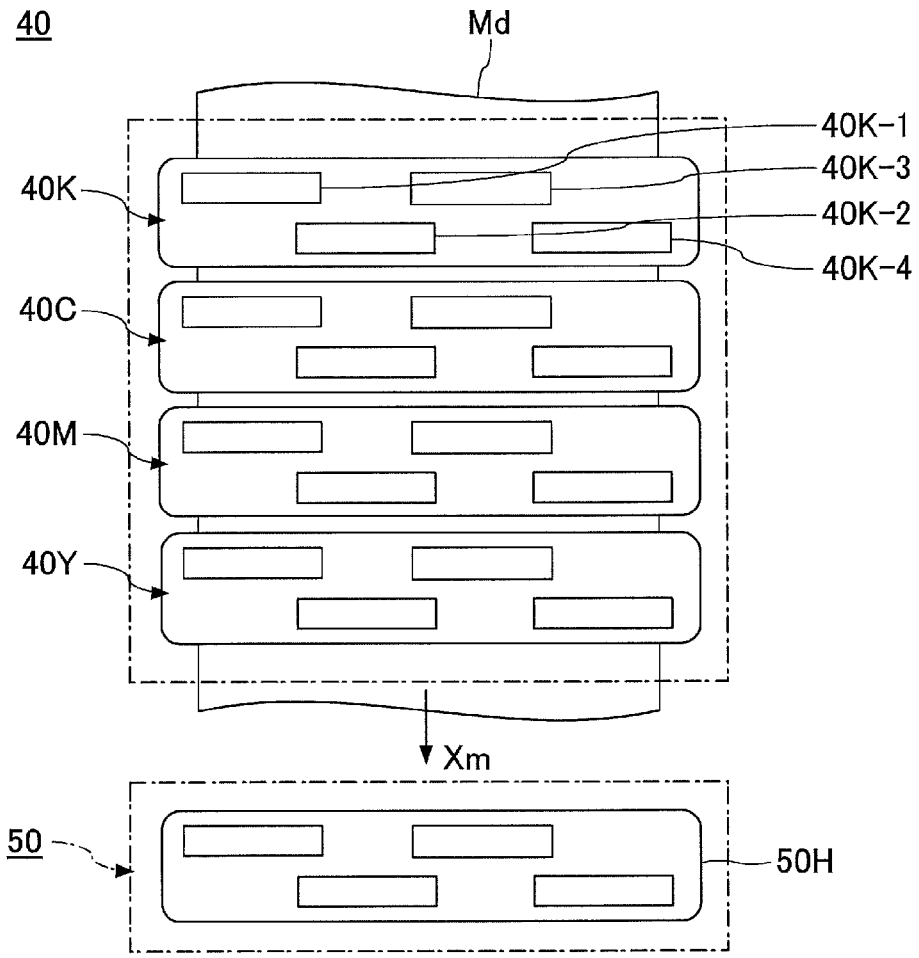
FIGS. 2A and 2B are bottom views of ejecting heads of an image forming unit and a post-processing liquid applying unit according to an embodiment of the present invention.
Figure 2B:
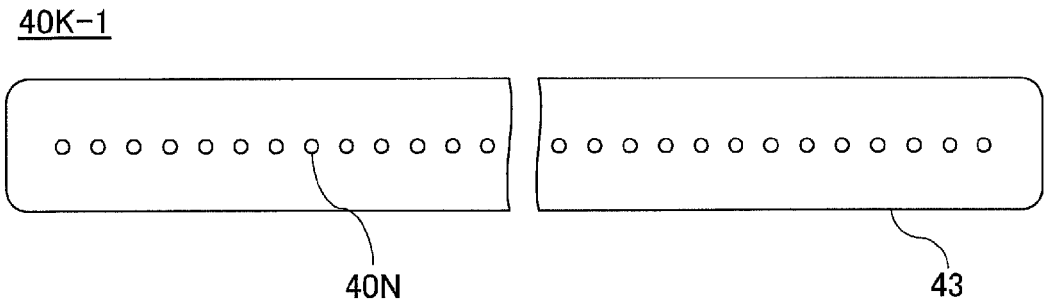

FIGS. 2A and 2B illustrate an example external configuration of the image forming unit 40 according to the present embodiment. FIG. 2A is a schematic plan view of the image forming unit 40 of the image forming apparatus 100 according to an embodiment of the present invention. FIG. 2B is a partial schematic plan view of a part of the image forming unit 40 (ejecting head 40K of black (K) ink).

As illustrated in FIG. 2A, the image forming unit 40 according to the present embodiment is a full-line type head having four ejecting heads 40K, 40C, 40M, and 40Y for different colors, black (K), cyan (C), magenta (M), and yellow (Y), arranged in the above recited order from the upstream side to the downstream side in a print medium conveyance direction Xm.

Note that the ejecting head 40K for ejecting the black (K) color ink includes four head units 40K-1, 40K-2, 40K-3, and 40K-4, arranged in a staggered manner in the direction perpendicular to the printing medium conveyance direction Xm. This enables the image forming apparatus 40 to form an image across the entire width of an image forming region (print region) of the rolled sheet Md (print medium). Note that the configurations of the other ejecting heads 40C, 40M, and 40Y are similar to that of the ejecting head 40K, and as such, descriptions thereof will be omitted.

FIG. 2B is an enlarged plan view of the head unit 40K-1 of the ejecting head 40K for ejecting black (K) ink of the image forming unit 40. As illustrated in FIG. 2B, in the present embodiment, the head unit 40K-1 includes a plurality of nozzles (ejecting holes, print nozzles) arranged on a nozzle surface (outer surface of nozzle plate 43 described below with reference to FIG. 3A). Note that the nozzles 40N are arranged along a longitudinal direction of the head unit 40K-1 to form a nozzle array. That is, the head unit 40K-1 may be a so-called single pass inkjet head having a nozzle array arranged in a main scanning direction. Note that the head unit 40K-1 may also have plural nozzle arrays.

Figure 3A:
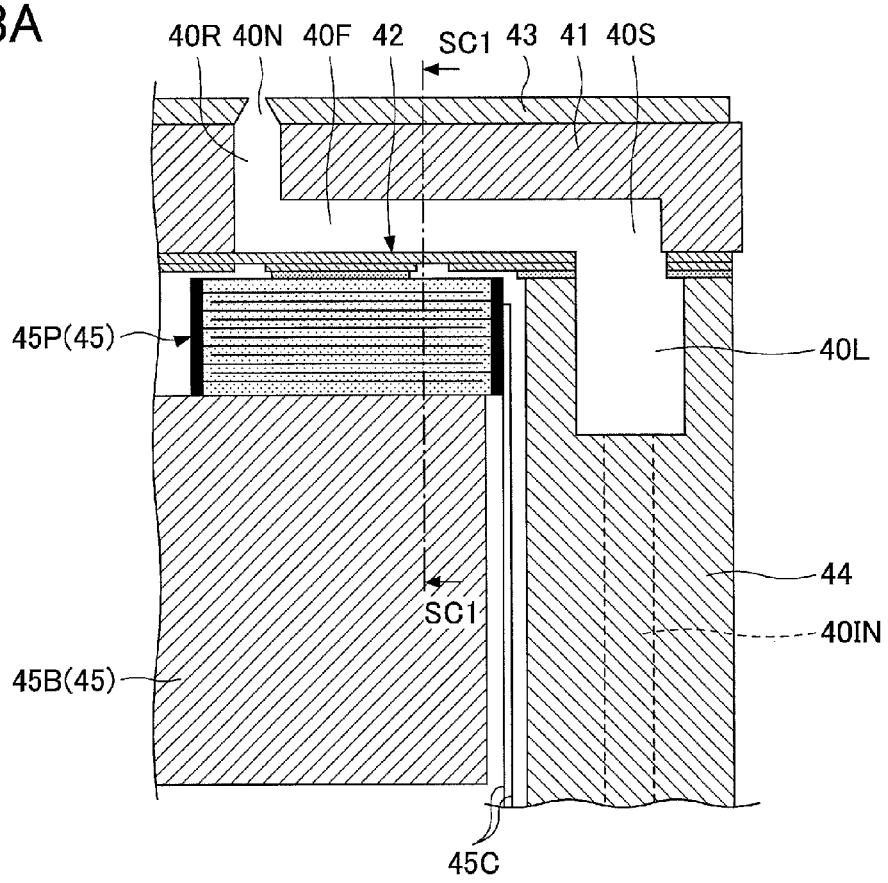
FIGS. 3A and 3B are cross-sectional views of an ejecting head of the image forming unit.
Figure 3B:
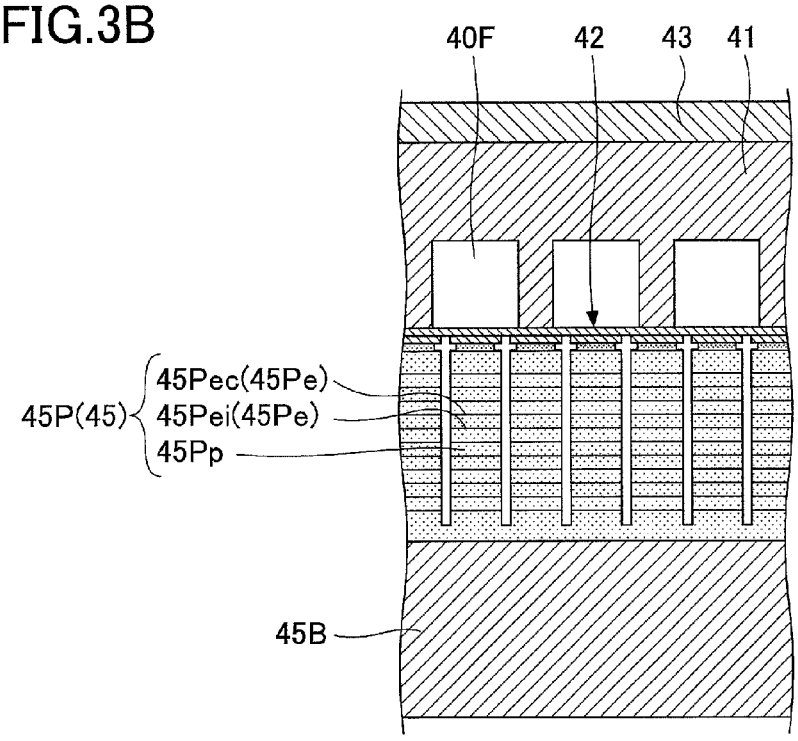

FIG. 3A is an example cross-sectional view of the ejecting head (e.g., ejecting head 40K) in the longitudinal direction of a liquid chamber 40F of the image forming unit 40. FIG. 3B is a cross-sectional view of the ejecting head in the lateral direction of the liquid chamber 40F of the image forming unit 40. FIG. 3B is a cross-sectional view across line SC1 of FIG. 3A.

In FIG. 3A, the ejecting head (e.g., ejecting head 40K) of the a flow channel plate 41 that forms a channel for ejecting ink, a vibrating plate 42 adjoining the lower surface of the flow channel plate 41, and a nozzle plate 43 adjoining the top surface of the flow channel plate 41, and a frame member 44 that holds a peripheral edge portion of the vibrating plate 42. The ejecting head also includes a pressure generating unit (actuator) 45 for causing deformation of the vibrating plate 42.

In the present embodiment, the flow channel plate 41, the vibrating plate 42, and the nozzle plate 43 are stacked to form a nozzle communication channel 40R that is a flow channel communicating with a nozzle 40N and a liquid chamber 40F. Also, by further stacking the frame member 44, an ink supplying port 40S for supplying ink to the liquid chamber 40F and a common liquid chamber 40L for supplying ink to the liquid chamber 40F may be formed in the ejecting head.

Also, in the present embodiment, the frame member 44 includes a chamber for accommodating the pressure generating unit 45, a recessed portion to constitute the common liquid chamber 40L, and an ink supply port 40IN for supplying ink to the common liquid chamber 40L from outside the ejecting head.

In the present embodiment, the pressure generating units 45 includes piezoelectric elements 45P as electromechanical elements, a base substrate 45B for mounting and fixing the piezoelectric elements 45P, and supporting pillar parts provided between the piezoelectric elements 45P.

As illustrated in FIG. 3B, the piezoelectric element 45P is a laminated-type piezoelectric element (PZT) that is formed by alternately laminating a piezoelectric material 45Pp and an internal electrode 45Pe. The internal electrode 45Pe includes a plurality of individual electrodes 45Pei and a plurality of common electrodes 45Pec. In the present embodiment, the individual electrode 45Pei and the common electrode 45Pec are alternately connected to end faces of the piezoelectric material 45P.

In the following, example operations of the ejecting head for ejecting ink from the nozzle N (pull-push ejection) are described.

First, the ejecting head lowers a voltage applied to the piezoelectric element 45P relative to a reference electric potential to cause contraction of the piezoelectric element 45P in its laminating direction. Also, by causing such contraction of the piezoelectric element 45P, the ejecting head causes the vibrating plate 42 to bend and deform. By causing such bending deformation of the vibrating plate 42, the ejecting head increase (expands) the volume of the liquid chamber 40F. By implementing such operations, the ejecting head causes ink to flow from the common liquid chamber 40L into the liquid chamber 40F.

Then, the ejecting head increases the voltage applied to the piezoelectric element 45P to cause expansion of the piezoelectric element 45P in the laminating direction. Also, by causing the expansion of the piezoelectric element 45P, the ejecting head causes the vibrating plate 42 to deform toward the direction of the nozzle 40N. By causing the deformation of the vibrating plate 42, the ejecting head reduces the volume of the liquid chamber 40F. By implementing such operations, the ejecting head applies pressure to the ink within the liquid chamber 40F. Also, by pressurizing the ink within the liquid chamber 40F, the ejecting head ejects the ink from the nozzle 40N.

Then, the ejecting head resets the voltage applied to the piezoelectric element 45P to the reference electric potential, and restores the vibrating plate 42 to the initial state. At this time, the liquid chamber 40F expands to cause the pressure within the liquid chamber 40F to decrease, and in this way, the ejecting head supplies (fills) ink in the liquid chamber 40F from the common liquid chamber 40L. Then, after the vibration of a meniscus surface at the nozzle 40N damps and is stabilized, the ejecting head transitions to operations for a next ink ejection.

As described above, the ejecting head uses the pressure generating unit 45 to cause deformation (bending deformation) of the vibrating plate 42. In this way, the ejecting head changes the volume of the liquid chamber 40F to thereby change the pressure applied to the ink within the liquid chamber 40F. As a result, the ejecting head ejects ink from the nozzle 40N.

Note that the method for driving the ejecting head is not limited to the above example (pull-push-ejection). In other examples, pull-ejection or push-ejection may be implemented by controlling the voltage (drive waveform) applied to the piezoelectric element P. Further, the pressure generating unit 45 is not limited to the above example (the piezoelectric element 45P). In other examples, the pressure generating unit 45 may be a thermal actuator including a heating resistor for heating the ink within the liquid chamber 40F and causing bubbles to be formed, or an electrostatic actuator that has a vibrating plate and an electrode arranged to face each other at a side wall of the liquid chamber 40F and uses an electrostatic force generated between the vibrating plate and the electrode to cause deformation of the vibrating plate, for example.

In this way, the image forming apparatus 100 according to the present embodiment can use the image forming unit 40 (the four ejecting heads 40K, 40C, 40M, and 40Y) to form a full-color image or a monochrome image over the entire width of an image forming region with one single conveyance operation of the print medium (rolled sheet Md).

(Post-Processing Liquid Applying Unit Configuration)

The post-processing liquid applying unit 50 performs post-processing on a print medium having an image formed thereon. In the present embodiment, the post-processing liquid applying unit 50 uses the post-processing liquid to perform post-processing on the surface of the rolled sheet Md on which an image was formed by the image forming unit 40. As illustrated in FIG. 2A, the post-processing liquid applying unit 50 is arranged downstream of the image forming unit 40 in the print medium conveyance direction Xm.

Further, the post-processing liquid applying unit 50 controls a drive waveform input to an ejecting head 50H to control the amount of post-processing liquid to be ejected. In this way, the post-processing liquid applying unit 50 can use the ejecting head 50H to eject (apply) the post-processing liquid onto the entire width of an image forming region (print region) of the rolled sheet Md (print medium). However, as described below, in the present embodiment, the post-processing liquid applying unit 50 does not necessarily have to apply the post-processing liquid over the entire print region and may instead implement post-processing in partial droplet ejection mode, which involves applying the post-processing liquid only on printed portions or on printed portions and surrounding portions thereof, for example. Note that the post-processing in partial droplet ejection mode is described in detail below with reference to FIGS. 9A and 9B. The configuration of the ejecting head 50H of the post-processing liquid applying unit 50 may be substantially identical to the configuration of the ejecting heads (40K, 40C, 40M, and 40Y) of the image forming unit 40 as described above with reference to FIGS. 2A through 3B, and as such descriptions thereof will be omitted.

Note that in the present descriptions, post-processing refers to a process of ejecting (depositing) the post-processing liquid onto the surface of the rolled sheet Md (print medium). By performing such a process, when the surface of the print medium having an image formed thereon rubs against another object (e.g., another print medium), the image (ink) formed on the surface of the print medium may be prevented from peeling. In other words, abrasion resistance of the image formed on the print medium may be improved. Further, glossiness and preservation stability (e.g., water resistance, light resistance, gas resistance) of the image may also be improved, for example.

(Penetration Unit Configuration)

The penetration unit 55 causes the solvent in ink to penetrate the print medium. In the penetration unit 55, the conveying distance of the rolled sheet Md is arranged to be long in order to secure adequate time for the solvent in the ink to penetrate the rolled sheet Md. Further, the penetration unit 50 uses the heating unit 56 (see FIG. 1) to heat the print medium and the ink to an atmospheric temperature of about 30° C. to 100° C. (temperature that would not cause moisture evaporation). In this way, the penetration unit 50 can accelerate the penetration speed of ink by reducing its viscosity while retaining the aqueous solution state of a high-boiling point solvent contained in the ink.

(Post-Processing Liquid Drying Unit)

The post-processing liquid drying unit 32 of FIG. 1 may heat a plurality of heat rollers to about 80° C. to 100° C., for example, and bring the rear side of the rolled sheet Md in contact with the heat rollers. Note that in some embodiments, a warm air heating mechanism may be provided in the post-processing liquid drying unit 32 similar to the trapezoid shaped heating unit 56 illustrated in FIG. 1, for example. In this way, the post-processing liquid drying unit 32 may be able to evaporate the moisture in the ink and the post-processing liquid and dry the rolled sheet Md.

(Discharge Unit Configuration)

The discharge unit 60 is for unloading (discharging) a print medium having an image formed thereon, for example. As illustrated in FIG. 1, in the present embodiment, the discharge unit 60 includes a storage unit 61 and a plurality of conveying rollers 62. The discharge unit 60 uses the conveying rollers 62 to wind the rolled sheet Md having an image formed thereon around a storage roller of the storage unit 61 to thereby store the rolled sheet Md.

Note that in a case where the pressure applied to the rolled sheet Md tends to increase upon winding the rolled sheet Md around the storage roller of the storage unit 61, a drying unit for further drying the rolled sheet Md right before it is wound around the storage roller may be provided in order to prevent an image formed on the surface of the rolled sheet Md from being transferred, for example.

(Control Unit Configuration)

The control unit 70 controls the operation of the image forming apparatus 100. In the present embodiment, the control unit 70 directs the various components of the image forming apparatus 100 to implement operations and controls these operations. In the following, the control unit 70 according to the present embodiment is described with reference to FIGS. 4A through 7.

The image forming apparatus 100 according to an embodiment of the present invention may implement production printing as the printing system. In the present descriptions, production printing refers to a production system that is capable of producing (printing) a large volume of printed material in a short period of time by efficiently performing job management and print data management, for example. Specifically, the image forming apparatus 100 according to the present embodiment includes a plurality of apparatuses, such as a RIP (Raster Image Processor) apparatus and a printer apparatus, for example. The RIP apparatus controls the printing order of print data and converts print data into raster image data, for example. The printer apparatus controls printing operations based on the converted raster image data, for example.

Also, the image forming apparatus 100 (control unit 70) according to the present embodiment implements a workflow system for managing processes from creating print data to distributing printed material. That is, the image forming apparatus 100 according to the present embodiment (control unit 70), divides processes of a long workflow such as that described above and distributes the divided processes to different apparatuses, such as the RIP apparatus and the printer apparatus. In this way, the printing speed may be increased. The image forming system (image forming apparatus 100) as a whole includes the RIP apparatus as a control apparatus or a superordinate apparatus, for example.

Figure 4A:
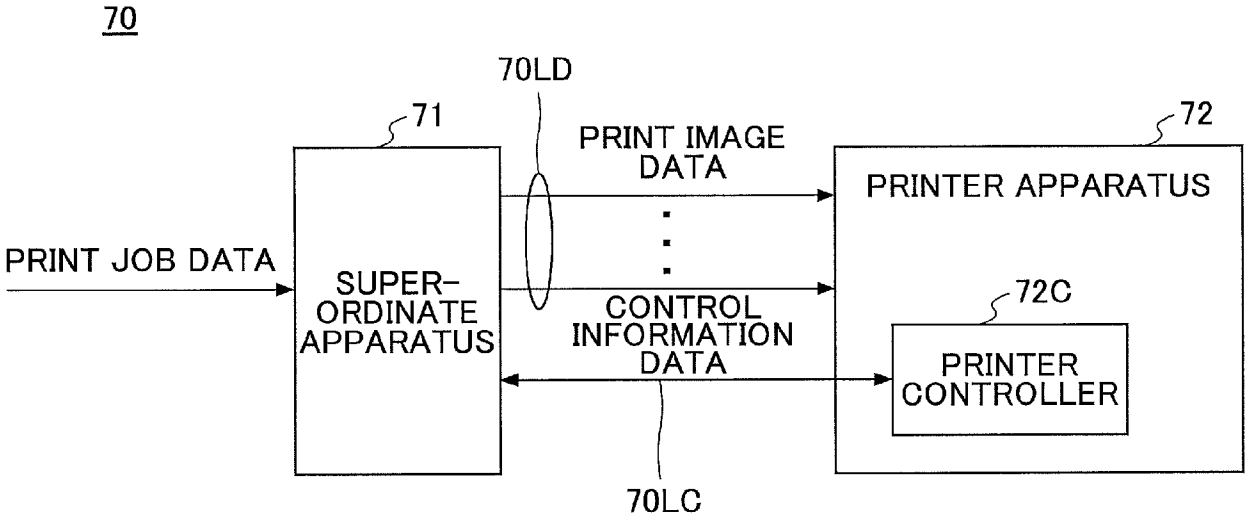
FIGS. 4A and 4B are block diagrams illustrating example configurations of an image forming system and a superordinate apparatus according to an embodiment of the present invention.
Figure 4B:
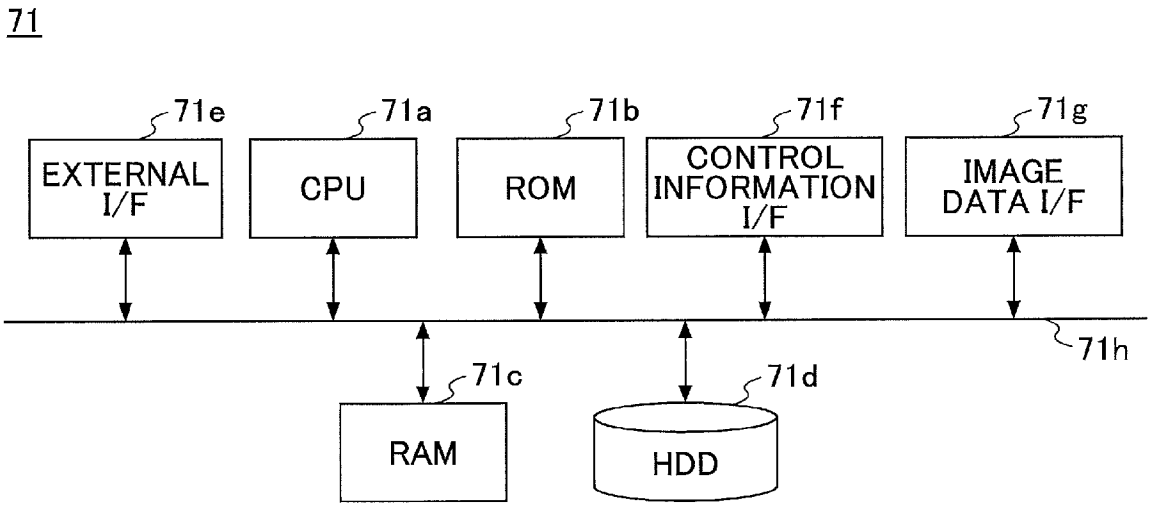

FIG. 4A is a conceptual diagram illustrating an example image forming system according to an embodiment of the present invention, and FIG. 4B is a schematic diagram illustrating an example configuration of a superordinate apparatus.

As illustrated in FIG. 4A, the control unit 70 of the image forming apparatus 100 according to the present embodiment includes a superordinate apparatus 71 (e.g., RIP apparatus, Digital Front End (DFE) apparatus) that performs raster image processing, for example, and a printer apparatus 72 that performs printing processes, for example. The superordinate apparatus 71 and the printer apparatus 72 are connected via a plurality of data lines 70LD and a plurality of control lines 70LC.

<Superordinate Apparatus>

The superordinate apparatus 71 of the image forming apparatus (control unit 70) according to the present embodiment produces raster image data (performs an RIP process) based on print job data (e.g., job data, print data) output from a host apparatus. That is, the superordinate apparatus 71 according to the present embodiment produces the raster image data (hereinafter referred to as print image data) corresponding to the ink colors, based on the print job data. The print image data also includes data related to ejecting the post-processing liquid by the post-processing liquid applying unit 50 (hereinafter referred to as post-processing liquid image data).

Also, the superordinate apparatus 71 produces the data for controlling the printing operations (hereinafter referred to as control information data), based on the print job data and information on the host apparatus, for example. The control information data includes information on printing conditions, such as the printing mode, the printing type, paper feeding/discharging information, the order of print surfaces, the printing paper size, the data size of print image data, the resolution, paper type information, grayscale information, color information, and the number of pages to be printed, for example. In the present embodiment, the control information data also includes post-processing liquid control data relating to the post-processing liquid to be ejected by the post-processing unit 50.

As illustrated in FIG. 4B, the superordinate apparatus 71 of the present embodiment includes a CPU (Central Processing Unit) 71*a*, a ROM (Read Only Memory) 71*b*, a RAM (Random Access Memory) 71*c*, and an HDD (Hard Disk Drive) 71*d*. The superordinate apparatus 71 also includes an external interface (I/F) 71*e*, a control information I/F 71*f*, and an image data I/F 71*g*. Moreover, the superordinate apparatus 71 includes a bus 71*h*, which connects the CPU 71*a* and the other components of the superordinate apparatus 71 with each other. That is, the bus 71*h* enables the respective components of the superordinate apparatus 71 to communicate and exchange data with each other.

The CPU 71*a* controls the entire superordinate apparatus 71. The CPU 71*a* uses a control program stored in the ROM 71*b* and/or the HDD 71*d* to control operations of the superordinate apparatus 71.

The ROM 71*b*, the RAM 71*c*, and the HDD 71*d* are storage units for storing programs and data. The control program for controlling the CPU 71*a* may be stored in the ROM 71*b* and/or the HDD 71*d* in advance, for example. The RAM 71*c* is used as a working memory of the CPU 71*a*.

The external I/F 71*e* controls external communications of the image forming apparatus 100 (e.g., with the host apparatus). The control information I/F 71*f* controls communication (transmission/reception) of the control information data. The image data I/F 71*g* controls communication (transmission/reception) of the print image data.

<Printer Apparatus>

Figure 5:
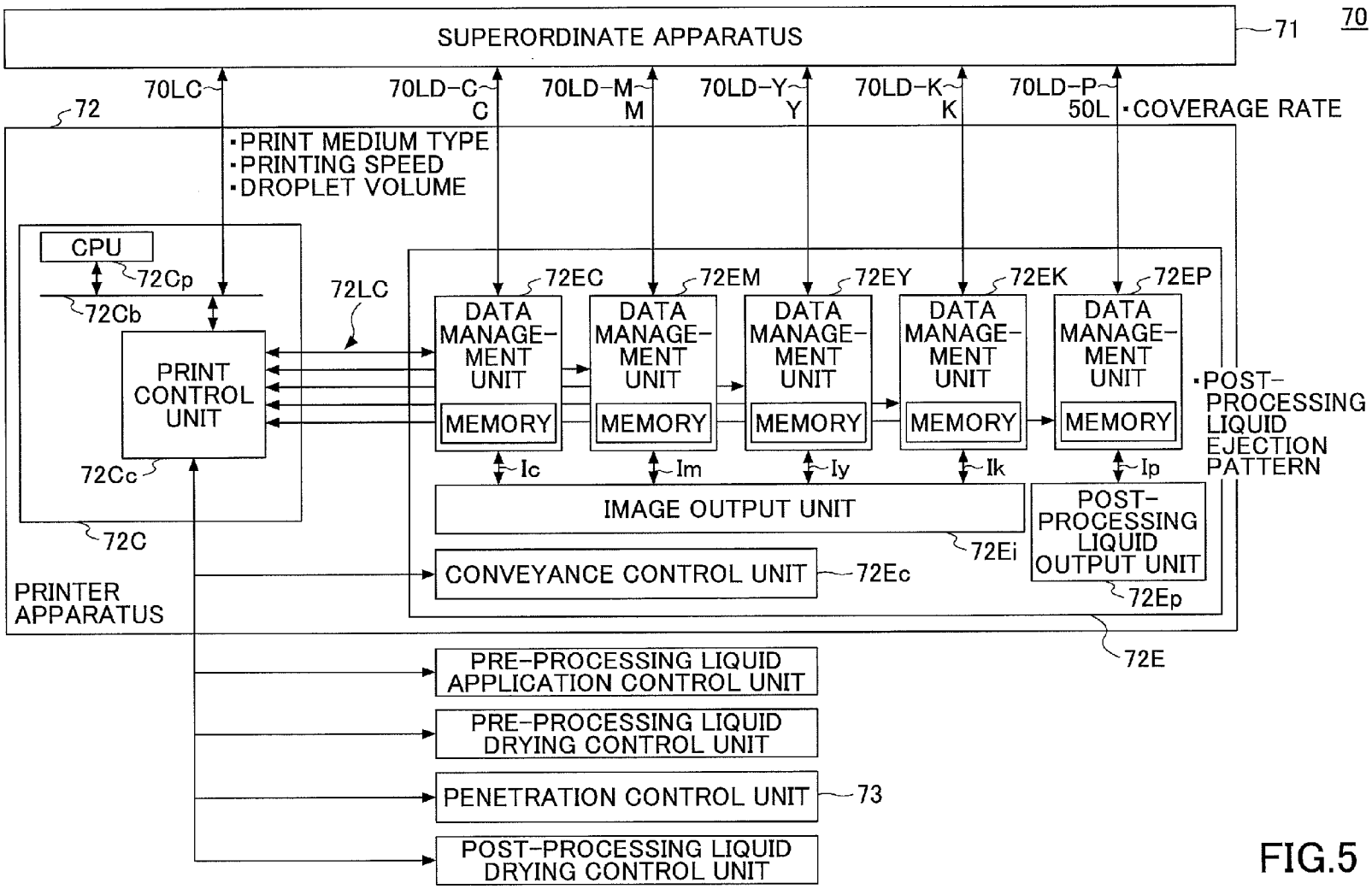
FIG. 5 is a block diagram illustrating an example functional configuration of the image forming apparatus according to an embodiment of the present invention.

FIG. 5 is a block diagram illustrating an example functional configuration of the image forming apparatus 100 according to an embodiment of the present invention. In the present embodiment, the printer apparatus 72 of the control unit 70 of the image forming apparatus 100 controls operations for forming an image on a print medium based on the print image data and the control information data received from the superordinate apparatus 71. The printer apparatus 72 includes a printer controller 72C and a printer engine 72E.

The printer controller 72C controls operations of the printer engine 72E. The printer controller 72C receives/transmits information, such as the control information data, from/to the superordinate apparatus 71 via the control line 70LC. Also, the printer controller 72C receives/transmits the control information data from/to the printer engine 72E via a control line 72LC. Further, the printer controller 72C can control the printer engine 72E, based on the control information data, to perform printing operations according to printing conditions, such as the print medium type, printing speed, and the amount of droplets (droplet volume) to be ejected (applied) that are specified in the control information data, for example.

In FIG. 5, the printer controller 72C includes a CPU 72Cp and a print control unit 72Cc. The CPU 72Cp and the print control unit 72Cc are connected via a bus 72Cp in the printer controller 72C. The bus 72Cb is connected to the control lines 70LC via a communication interface.

The CPU 72Cp controls operations of the entire printer apparatus 72 using a control program stored in the ROM 71*b* (see FIG. 4B). The print control unit 72Cc receives/transmits commands and/or status information from/to the printer engine 72E based on the control information data received from the superordinate apparatus 71, and in this way, the print control unit 72Cc controls the operations of the printer engine 72E.

The printer engine 72E controls operations for forming an image on a print medium based on the print image data received from the superordinate apparatus 71 and the control information data received from the printer controller 72C. Also, the printer engine 72E controls the post-processing operations based on the print image data (post-processing liquid image data) received from the superordinate apparatus 71 and the control information data (post-processing control data) received from the printer controller 72C.

As illustrated in FIG. 5, the printer engine 72E is connected to the plurality of data lines 70LD (70LD-Y, 70LD-C, 70LD-M, 70LD-K, and 70LP-P). The printer engine 72E receives the print image data from the superordinate apparatus 71 via the plurality of the data lines (e.g., 70LD-C). In this way, the printer engine 72E can control the operations for printing in various colors and the post-processing operations based on the received print image data.

In the present embodiment, the printer engine 72E includes a plurality of data management units 72EC, 72EM, 72EY, and 72EK. The printer engine 72E includes an image output unit (e.g., head module) 72Ei that receives data such as print image data from the data management units 72EC, 72EM, 72EY, 72EK, and 72EP. Also, the printer engine 72E includes a conveyance control unit 72Ec that controls the conveying of the print medium. Further, the printer engine 72E includes a post-processing liquid output unit 72EP that receives print image data relating to post-processing from the data management unit EP.

Note that the printer engine 72E may further include or be connected to a post-processing liquid drying control unit, a pre-processing liquid application control unit, a pre-processing liquid drying control unit, a penetration control unit 73, and a pre-rollup drying control unit (not shown), for example.

Figure 6:
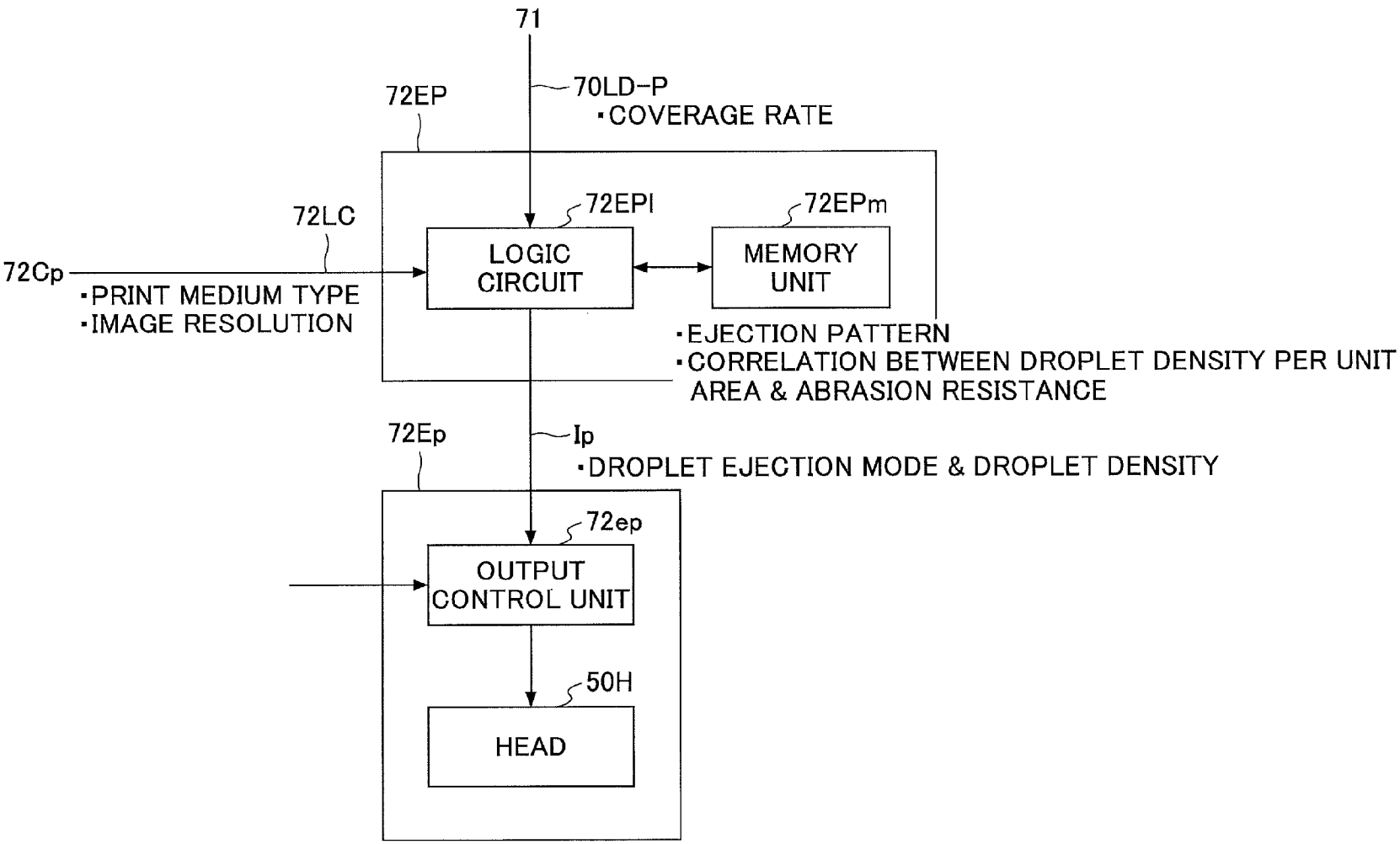
FIG. 6 is a block diagram illustrating an example functional configuration of a data management unit of a control unit according to an embodiment of the present invention.

In the following, the configuration of the data management unit 72EC for managing data related to post-processing is described with reference to FIG. 6. FIG. 6 is a block diagram illustrating an example functional configuration of the data management unit 72E. In FIG. 6, the data management unit 72EC includes a logic circuit 72EC1 and a memory unit 72ECm. The data management unit 72EC (the logic circuit 72EC1) is connected to the superordinate apparatus 71 via the data line 70LD-C. The data management unit 72EC (the logic circuit 72EC1) is connected to the printer controller 72C (print control unit 72Cc) via the control line 72LC.

The logic circuit 72EC1 stores the print image data relating to post-processing output by the superordinate apparatus 71 in the memory unit 72ECm, based on a control signal output by the printer controller 72C (print control unit 72Cc).

The memory unit 72ECm stores the print image data output by the superordinate apparatus 71 based on the control signal output by the printer controller (print control unit 72Cc).

Also, a logic circuit 72EC1 of the data management unit EC reads print image data (drive waveform) Ic corresponding to cyan (C) from a memory unit 72ECm (see FIG. 5) and outputs the read data to the image output unit 72Ei.

The logic circuit 72EP1 of the data management unit 72EP receives from the print control unit 72Cc, which corresponds to a control unit for controlling the entire image forming system, information, such as the type of print medium, the printing speed, and the resolution of the image to be formed. The logic circuit 72EC1 also receives the coverage rate from the superordinate apparatus 71. Note that although the logic circuit 72EP1 receives the coverage rate from the superordinate apparatus 71 in the examples illustrated in FIGS. 5 and 6, in other examples, the print control unit 72Cc may be configured to calculate the coverage rate and send the calculated coverage rate to the logic circuit EP1.

The logic circuit 72EP1 selects a combination of the post-processing liquid droplet ejection mode and the droplet amount (droplet density) per unit area based on the coverage rate received from the superordinate apparatus 71 (or the print control unit Cc). More specifically, when the received coverage rate is high, "full-page droplet ejection mode×low droplet density" is selected, and when the received coverage rate is low, "partial droplet ejection mode×high droplet density" is selected.

Further, the logic circuit 72EP1 adjusts the droplet amount (droplet density) per unit area based on the information on the print medium type, the printing speed, and the resolution of the image to be formed received from the print control unit Cc.

The logic circuit 72EP1 outputs a waveform corresponding to a post-processing liquid ejection pattern (specific ejection pattern) Ip (see FIG. 5) for the droplet ejection mode and the droplet density that have been selected/adjusted as described above to the post-processing liquid output unit 72Ep.

Note that the data management unit 72EP may be implemented by a hardware logic circuit configured by a combination of a plurality of logical circuits, for example.

Figure 7:
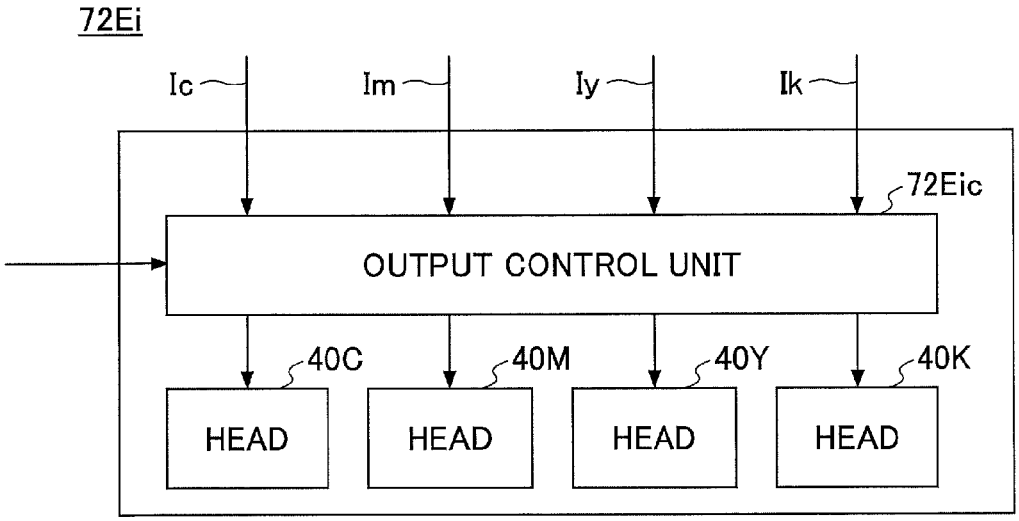
FIG. 7 is a block diagram illustrating an example functional configuration of an image output unit of the control unit according to an embodiment of the present invention.

In the following, the configuration of the image output unit 72Ei is described with reference to FIG. 7. As illustrated in FIG. 7, the image output unit (head module) 72Ei includes an output control unit 72Eic and the plurality of ejecting heads 40C, 40M, 40Y, and 40K. The output control unit 72Eic outputs print image patterns (drive waveforms) based on the print image data (image information) corresponding to the colors C, M, Y, and K to the ejecting head 40C, 40M, 40Y, and 40K corresponding to the above colors. In this way, the output control unit 72Eic can control operations of the ejecting heads 40C, 40M, 40Y, and 40K based on the print image data.

Specifically, drive waveforms corresponding to the print image patterns (Ic, Im, Iy, Ik) generated by the respective logic circuits of the data management units 72EC, 72EM, 27EY, and 72EK are applied to the piezoelectric elements 45P corresponding to pressure generating units of the ejecting heads 40C, 40M, 40Y, and 40K at controlled timings controlled by the output control unit 72Ec. When the drive waveforms are applied the piezoelectric elements 45P, this causes the piezoelectric elements 45P to contract/expand. In turn, the contraction/expansion force generated at the piezoelectric element 45 is applied to the ink within the liquid chamber 40F via the vibrating plate 42 such that the pressure within the liquid chamber 40 is changed. As a result, the ink droplets are ejected from the nozzle 40N. In this way, the output control unit 72Eic controls the operations of the ejecting heads 40C, 40M, 40Y, and 40K based on the print image patterns (drive waveforms) Ic, Im, Iy, and Ik.

The output control unit 72Eic individually controls the plurality of the ejecting heads 40C, 40M, 40Y, and 40K. The output control unit 72Eic may simultaneously control the plurality of the ejecting heads 40C, 40M, 40Y, and 40K, based on the print image data (Ic, Im, Iy, and Ik in FIG. 5). Furthermore, the output control unit 72Eic may control the ejecting heads 40C, 40M, 40Y, and 40K based on a control signal input by a control apparatus (not shown), for example. Also, the output control unit 72Eic may control the ejecting heads 40C, 40M, 40Y, and 40K based on a user operation input from a user, for example.

Note that the post-processing liquid output unit (head module) 72Pp may have a configuration similar to that illustrated in FIG. 7. That is, the post-processing liquid output unit (head module) 72Pp may include an output control unit and the ejecting head 50H (see FIG. 2). The output control unit of the post-processing liquid output unit (head module) 72Pp may output the post-processing liquid ejection pattern Ip to the ejecting head 50H. Specifically, the drive waveform corresponding to the post-processing liquid ejection pattern Ip generated by the logic circuit 72EC1 of the data management unit 72EP is applied to the piezoelectric element 45P of the ejecting head 50H at controlled timings controlled by the output control unit. This causes a pressure change in the liquid chamber 40F via the vibration plate 42 such that droplets of the post-processing liquid are ejected from the nozzle 50 N. In this way, the output control unit can control operations of the ejecting head 50H based on post-processing liquid ejection pattern (drive waveform) Ip.

As described above, the printer apparatus 72 is capable of individually controlling image formation in each of the colors. Also, the printer apparatus 72 may change the configuration of the printer engine 72E based on the number of colors of the print image data (e.g., C, M, Y, and K or only K) or the number of ejecting heads.

Referring back to FIG. 5, the image forming apparatus 100 may use the penetration control unit 73 and the post-processing liquid drying control unit that are connected to the print control unit 72Cc to control the drying unit 30 and the penetration unit 55 based on information, such as the print medium type, the printing speed, and the amount of post-processing liquid to be applied (droplet volume) included in the control information data, for example.

Further, the image forming apparatus 100 may use the pre-processing liquid control unit and the pre-processing liquid drying unit that are connected to the print control unit 72Cc to control pre-processing operations based on the print medium type and the print image data, for example.

(Post-Processing Liquid Ejection Pattern Control)

Figure 8:
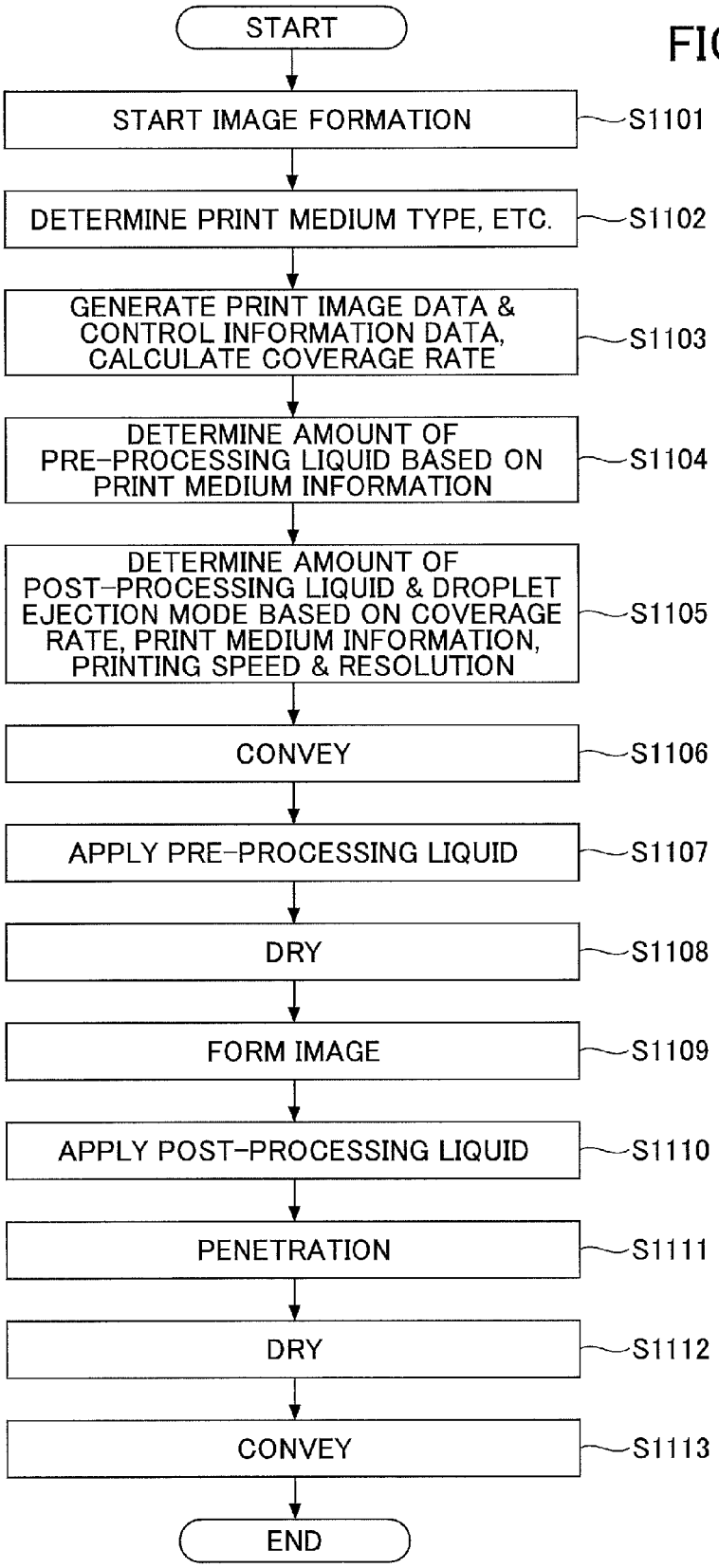
FIG. 8 is a flowchart illustrating an example operation of the image forming apparatus according to an embodiment of the invention.

FIG. 8 is a flowchart illustrating an image forming operation (flow) and a post-processing liquid application method. Note that the above-described elements of the image forming apparatus 100 may perform the following process steps to implement an image forming operation according to an embodiment of the present invention.

In step S1101, the image forming apparatus 100 starts an image forming operation for forming a character and/or an image by ejecting (depositing) ink on a print medium based on print job data input to the image forming apparatus 100 from the exterior. Further, the image forming apparatus 100 stores the input print job data in a storage unit, such as the ROM 71*b*, the RAM 71*c*, or the HDD 71*d* (hereinafter also referred to as storage unit 71*b*, 71*c*, or 71*d*), for example.

In step S1102, the image forming apparatus 100 uses the control unit 70 to determine settings such as the type of print medium to be used, and sets up (stores) the determined settings (e.g., type of printing paper) in the storage unit 71*b*, 71*c*, or 71*d*, for example.

In step S1103, the image forming apparatus 100 uses the data storage in the storage unit 71*b*, 71*c*, or 71*d* and the control unit 70 to generate print image data and control information data, for example. Specifically, the image forming apparatus 100 may generate the print image data and the control information data based on the print job data and the type of print medium stored in the HDD 71*d*, for example. Also, the image forming apparatus 100 calculates the coverage rate based on the generated print image data and control information data.

In step S1104, the image forming apparatus 100 uses the control unit 70 to determine the amount of pre-processing liquid (the amount to be applied in the present embodiment) and the drying strength of the pre-processing liquid upon being dried in step S1108.

In step S1105, the image forming apparatus 100 uses the control unit 70 to determine the amount of post-processing liquid (amount to be applied in the present embodiment) and the droplet ejection mode. Note that in the present embodiment, the image forming apparatus 100 selects the "partial droplet ejection mode×high droplet density" or "full-page droplet ejection mode×low droplet density" as the droplet ejection mode to be implemented. Also, the image forming apparatus 100 determines the drying strength of the post-processing liquid upon being dried in step S1112.

Note that the post-processing liquid applying unit 50 according to the present embodiment may use the ejecting head 50H to eject (deposit) the post-processing liquid onto any region (any location) of a print region of a print medium at a desired ejection quantity (in a desired dot pattern or a desired stripe pattern).

For example, the post-processing liquid applying unit 50 according to the present embodiment may implement the following method for applying the post-processing liquid 50L.

(1) Select droplet ejection mode based on coverage rate and set up ejection pattern; and (2) Control the amount of the post-processing liquid 50L to be ejected.

Specifically, the post-processing liquid applying unit 50 may calculate the coverage rate and the amount of the post-processing liquid 50L based on information input thereto (e.g., print image data), and determine the pattern to be ejected based on the calculated coverage rate, for example.

Further, in some embodiments, the post-processing liquid applying unit 50 may be configured to arrange the above data into a database, for example, calculate the coverage rate and the amount of ink based on information input thereto (i.e., image data), compare the calculated values with the database, and determine the application range of the post-processing liquid.

Note that in a droplet ejection mode for partially applying droplets of the post-processing liquid only on a printed portion (portion of a print region of a print medium to which ink for forming a character and/or an image is attached), or only on the print portion and surrounding portions thereof, the friction coefficient of a portion of the print medium upon rubbing against another print medium is higher when the portion does not have the post-processing liquid applied thereon as compared with the friction coefficient when portions both having the post-processing liquid applied thereon rub against one another. Thus, the abrasion resistance of the printed portion is degraded in this case.

Accordingly, in order to maintain an abrasion resistance equivalent to that achieved when the post-processing liquid is applied in full-page droplet ejection mode, the amount of post-processing liquid applied per unit area has to be increased at the portions where the post-processing liquid is applied. Note that specific examples of implementing the partial droplet ejection mode and the full-page droplet ejection mode are described in detail below with reference to FIGS. 9A-9C.

Note that when the coverage rate is low, the partial droplet ejection mode may be implemented in order to avoid the problem of unnecessarily wasting a large amount of the post-processing liquid by applying the post-processing liquid over the entire surface of the print region of the print medium even though the printed portion occupies only a small area of the print region.

However, in the partial droplet ejection mode for partially applying the post-processing liquid only on a printed portion or only on the printed portion and surrounding portions thereof, the amount of post-processing liquid to be applied per unit area has to be increased. In this case, if the coverage rate is high, problems associated with poor drying that adversely affect the printing quality (e.g., picking, sticking) may easily occur, and the cost per page may be even higher than that when the full-page droplet ejection mode is implemented.

In view of the above, in the present embodiment, a threshold is set up and used to control whether to implement the partial droplet ejection mode or the full-page droplet ejection mode based on the amount of liquid to be applied. That is, the image forming apparatus 100 according to the present embodiment is configured to select the "full-page droplet ejection mode×low droplet density" when the coverage rate is high, and select "partial droplet ejection mode× high droplet density" when the coverage rate is low.

By controlling selection of the droplet ejection mode in the above-described manner, the amount of post-processing liquid applied may be reduced whether the coverage rate is low or high, problems associated with poor drying when the coverage rate is high may be avoided, and the cost per page (CPP) required in post-processing may be reduced.

In step S1106, the image forming apparatus 100 uses the conveying unit 10 to convey the print medium to the pre-processing liquid applying unit 20. Note that in some embodiments, the image forming apparatus 100 may execute the process of step S1106 immediately after starting image forming operation in step S1101.

In step S1107, the image forming apparatus 100 uses the pre-processing liquid applying unit 20 to perform pre-processing on the print medium by applying the pre-processing liquid thereon.

In step S1108, the image forming apparatus 100 uses the pre-processing liquid drying unit 31 to dry the print medium. Note that the pre-processing liquid drying unit 31 dries the print medium based on the pre-processing liquid drying strength determined in step S1104.

In step S1109, the image forming apparatus 100 uses the image forming unit 40 to form an image on the surface of the print medium based on the print image data generated in step S1103.

Note that the image forming unit 40 may further use the information on the print medium type and the resolution of the image to be formed to form the image on the print medium. Also, the image forming unit 40 may control the voltage (drive voltage) applied to the piezoelectric element 45P, to control the operation for forming the image.

In step S1110, the image forming apparatus 100 uses the post-processing liquid applying unit 50 to perform post-processing on the print medium. Specifically, the post-processing liquid applying unit 50 applies the post-processing liquid only to a printed portion of the print medium (portion to which ink forming a character and/or an image is attached), only to the printed portion and surrounding portions thereof, or over the entire print region of the print medium, based on the amount of the post-processing liquid and the droplet ejection mode determined in step S1105.

In step S1111, the image forming apparatus 100 uses the penetration unit 55 to cause the ink and the post-processing liquid to penetrate the print medium.

In step S1111, the image forming apparatus 100 uses the post-processing liquid drying unit 32 to dry the print medium. Note that the post-processing liquid drying unit 32 dries the print medium based on the drying strength determined in step S1105.

In step S1112, the image forming apparatus 100 uses the discharge unit 60 to unload (discharge) the print medium. Thereafter, the image forming apparatus 100 ends the present image forming operation.

(Post-Processing Liquid Ejection Patterns)

Figures 9A, 9B, 9C:
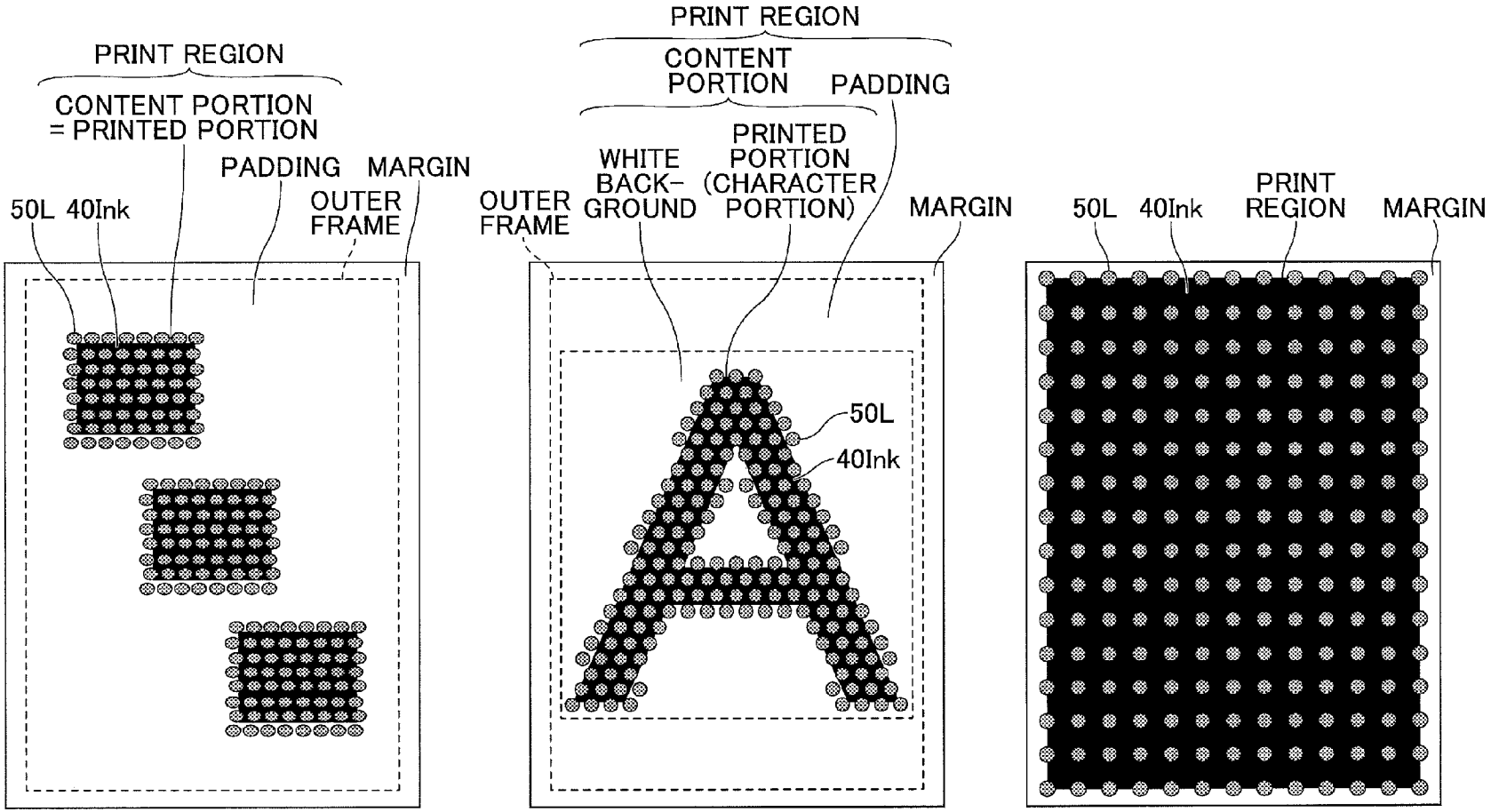
FIGS. 9A-9C are diagrams illustrating a partial droplet ejection mode and a full-page droplet ejection mode for ejecting a post-processing liquid according to an embodiment of the present invention.

FIGS. 9A-9C are diagrams for describing the droplet ejection modes for ejecting the post-processing liquid. In an embodiment of the present invention, for example, before the post-processing liquid applying unit 50 starts ejecting droplets of the post-processing liquid 50L on the surface of the rolled paper Md, the pre-processing liquid 20L is applied on the surface (not shown), and ink 40Ink forming an image is further applied on the surface. The post-processing liquid applying unit 50 of the image forming apparatus 100 performs post-processing on the surface of the rolled paper Md having an image formed thereon by ejecting (depositing) the post-processing liquid 50L on the surface.

Note that the droplet ejection mode to be used for ejecting the post-processing liquid is selected from the following options based on the coverage rate of the print job data determined in step S1105. That is, "partial droplet ejection mode×high droplet density" is selected when the coverage rate is lower than a predetermined threshold (see FIGS. 9A and 9B), and "full-page droplet ejection mode×low droplet density" is selected when the coverage rate is higher than the predetermined threshold (see FIG. 9C).

Specifically, either "partial droplet ejection mode×high droplet density" as illustrated in FIG. 9A or 9B or "full-page droplet ejection mode×low droplet density" as illustrated in FIG. 9C is selected as the droplet ejection mode. Note that partial droplet ejection mode refers to forming an ejection pattern for ejecting the post-processing liquid on a printed portion of a print region of a print medium (portion to which ink forming a character and/or an image is attached), or forming the ejection pattern on the printed portion and surrounding portions thereof. The full-page droplet ejection mode refers to forming an ejection pattern for ejecting the post-processing liquid over the entire surface of the print region of the print medium.

Note that in FIGS. 9A-9C, the print medium includes elements, such as a margin, a border (outer frame) defining the print region, a content portion within the border (print region) where a character and/or an image is formed, and a padding corresponding to a blank portion within the print region that is not a content portion.

The print region corresponds to a printable region inside the border including all portions of the print medium except for the margin.

The content portion is a portion of the print region excluding the padding (blank portion) of the print region. In the case of forming an image or a character, for example, instead of recognizing each individual character, the content portion may be defined in blocks (content box) excluding the padding (blank portion).

Note that in the case of printing a solid image (image that does not include a white portion) as illustrated in FIG. 9A, for example, the content portion corresponds to a printed portion. However, in the case of printing a character as illustrated in FIG. 9B, for example, the content portion includes a printed portion (character portion) and a white background portion.

The printed portion refers to a portion of the print region of the recording medium to which ink forming a character and/or an image is attached. In the case where a character or an image including a white portion (e.g., black and white line image) is formed, the content portion is larger than the printed portion because the content portion includes a white background portion where ink is not attached.

Note that the coverage rate refers to the total area of the printed portion occupying a page (print region) of the print medium, and is calculated as follows.

Total Area of Printed Portion/Area of Print Region

For example, in the case where the print region includes a plurality of content portions as illustrated in FIG. 9A, the areas of all the content portions are added up to calculate the total area of the content portions. The same applies to a case where one print region includes a plurality of content portions having a character, an image, and/or a line image formed therein, for example.

When the calculated coverage rate is low (less than the predetermined threshold), the post-processing liquid is partially applied on the printed portion (e.g., the non-white image portion corresponding to the printed portion in FIG. 9A or the character portion corresponding to the printed portion in FIG. 9B) of the content portion at a high density (i.e., partial droplet ejection mode is implemented). In the case of printing text, for example, the content portion corresponds to a continuing sequence of characters, and as such, the coverage rate tends to be relatively low. Thus, when the partial droplet ejection mode is selected in such a case, the post-processing liquid may be selectively ejected on each of the small characters included in the text.

Note that as the specific calculation method used to calculate the coverage rate, the print coverage method of calculating the coverage rate based on the actual area measurement of the printed portion (e.g., used in copying) may be used, or the dot ratio method of calculating the coverage rate based on the number of dots of the print data that is converted into the area of the printed portion may be used, for example.

Also, in some embodiments, when implementing the partial droplet ejection mode, the post-processing liquid may be deposited on a surrounding portion that extends from the printed portion by a predetermined width as illustrated in FIG. 9A and FIG. 9B, for example.

Note that in the present descriptions, the surrounding portion of the printed portion refers to a portion surrounding the printed portion having a predetermined width. The predetermined width may be about several micrometers to several centimeters, for example. As one example, the predetermined width may be several hundred micrometers.

Note that in the partial droplet ejection mode, the predetermined width of the surrounding portion may be set to 0 (zero) to control the post-processing liquid to be applied only on the printed portion of the print medium, for example.

The predetermined width of the surrounding portion of the printed portion is preferably adjusted to a suitable value based on the ink ejection position accuracy (print position accuracy) of the image forming unit and/or the resolution of the image to be formed, for example. If image forming unit has poor accuracy and/or the resolution of the image to be formed is high, for example, the predetermined width of the surrounding portion of the printed portion may be adjusted to be relatively wide. On the other hand, if the image forming unit has high accuracy and/or the resolution of the image to be formed is low, the predetermined width may be adjusted to be relatively narrow. That is, the dot size increases as the resolution decreases, and in such case, ink applied to the printed portion may be less susceptible to peeling.

Also, in the case where the printed portion includes a line segment that is slanted with respect to the width direction and the conveying direction of the print medium or includes a curved line as illustrated in FIG. 9B, for example, because the ejecting positions of the nozzle are arranged at regular intervals, it may be difficult to strictly eject the post-processing liquid along the surrounding portion having a predetermined width from the printed portion. In such a case, the width of the surrounding portion of a printed portion within one print region may slightly vary depending on different locations of the printed portion, for example.

(Post-Processing Liquid Ejection Pattern Selection Method)

The threshold used for selecting whether to implement "partial droplet ejection mode×high droplet density" or "full-page droplet ejection mode×low droplet density" may be calculated and set up based on the coverage rate as described below, for example.

Note that the coverage rate is calculated using one page as a reference area. Note that "one page" of a print medium may vary depending on the type of print medium as described below.

(1) If cut sheets are used as the print medium, one page corresponds to one print region of one sheet excluding the margin.

Figure 10:
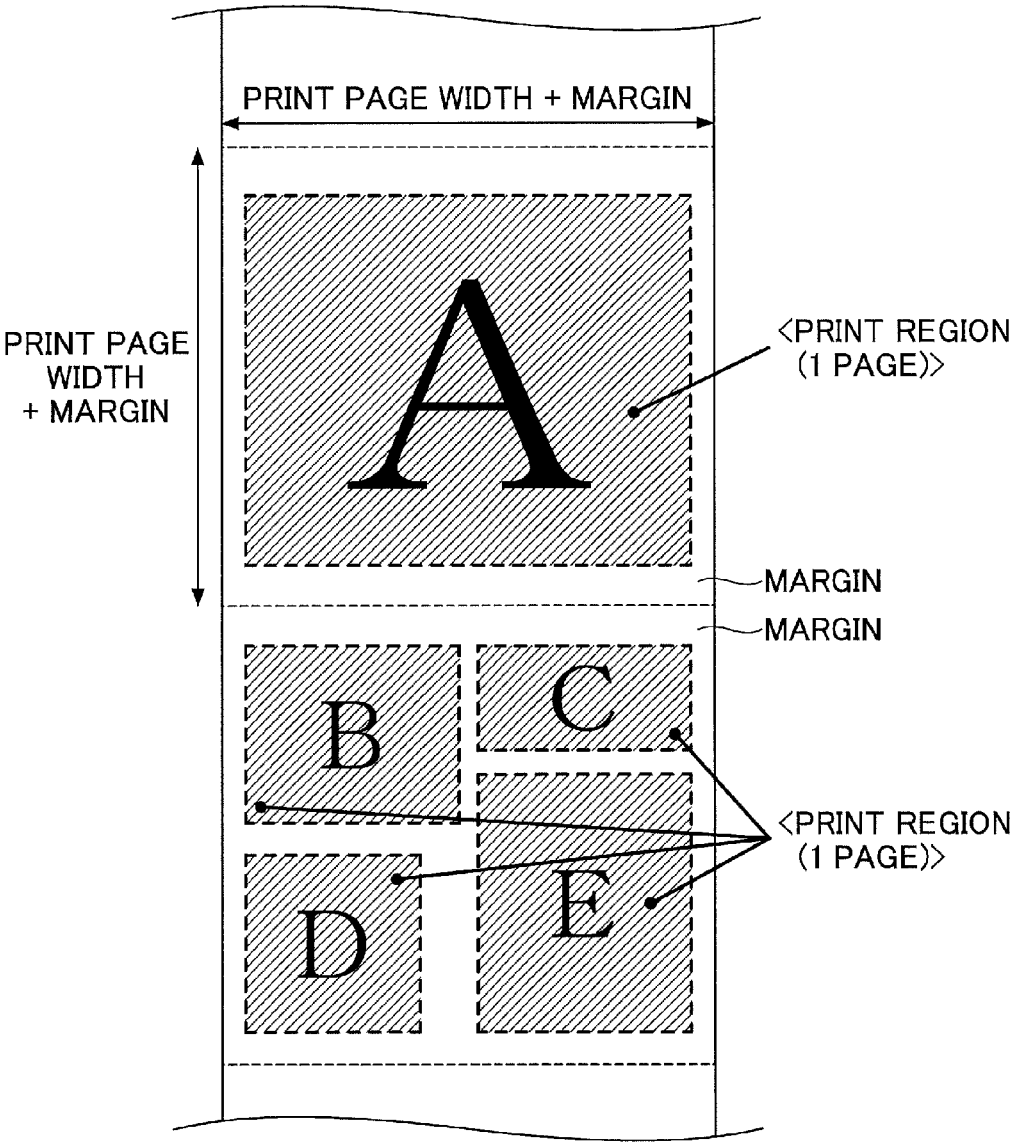
FIG. 10 is a diagram explaining the coverage rate in the case of using rolled paper.

(2) If a rolled sheet is used as the print medium, multiple print regions may be arranged within one print page width as illustrated in FIG. 10, for example.

In the following, "one page" in the case of using a rolled sheet as the print medium is described. Because the rolled sheet is a continuous sheet, when performing a printing operation on the rolled sheet, a print region may be arranged within a region defined by "print page width+margin" as illustrated by hatched portions in FIG. 10, for example.

As illustrated at the upper side of FIG. 10, when one print region (print region A) is arranged in one page (single imposition), the coverage rate corresponds to the ratio of the printed area (area of printed portion where ink forming a character and/or an image is applied) to the area of the print region (one page) corresponding to the reference area.

On the other hand, as illustrated at the lower side of FIG. 10, when a plurality of printing operations are performed within the region defined by the print page width (multiple imposition), a reference area is set up for each of a plurality of print regions (B, C, D, E) that are each recognized as one page, and the coverage rate is calculated with respect to each page (each print region). Note that in multiple imposition printing, multiple print regions corresponding to multiple pages are printed within one print page width of the rolled sheet, and the printed sheet may be cut such that the same pages may be stacked one on top of the other in a subsequent step, for example.

Note that in some embodiments, the margin outside the print region may be used to output information such as the cutting position, output information (date, etc.), and/or patch information for color confirmation, for example. Also, the margin may be used to perform a flashing operation for ejecting ink (droplets) to avoid thickening of the ink, for example.

Also, note that even when the coverage rate of one page is the same, the printed portion can be a solid image formed within the print region of the print medium or multiple printed portions distributed within the print region of the print medium, for example. However, in the present embodiment, no particular distinction is made between the case where a solid image is formed on a part of the print region and the case where printed portions are dispersed within the print region, and whether to implement full-page droplet ejection mode or partial droplet ejection mode is uniformly determined simply based on the coverage rate.

Note that the abrasion resistance of a region may be unambiguously determined based on the relationship between the amount of post-processing liquid to be applied per unit area and the amount of head applied per unit area.

Also, note that the threshold to be used for determining whether to select "partial droplet ejection mode×high droplet density" as illustrated in FIGS. 9A and 9B or "full-page droplet ejection mode×low droplet density" as illustrated in FIG. 9C may be calculated in the following manner.

<Threshold Setting>

The following procedures are implemented with respect to the print medium to be used for printing.

(1) Prepare print sample having predetermined print pattern indicating the level of the post-processing liquid amount ejected thereon.

Figure 11:
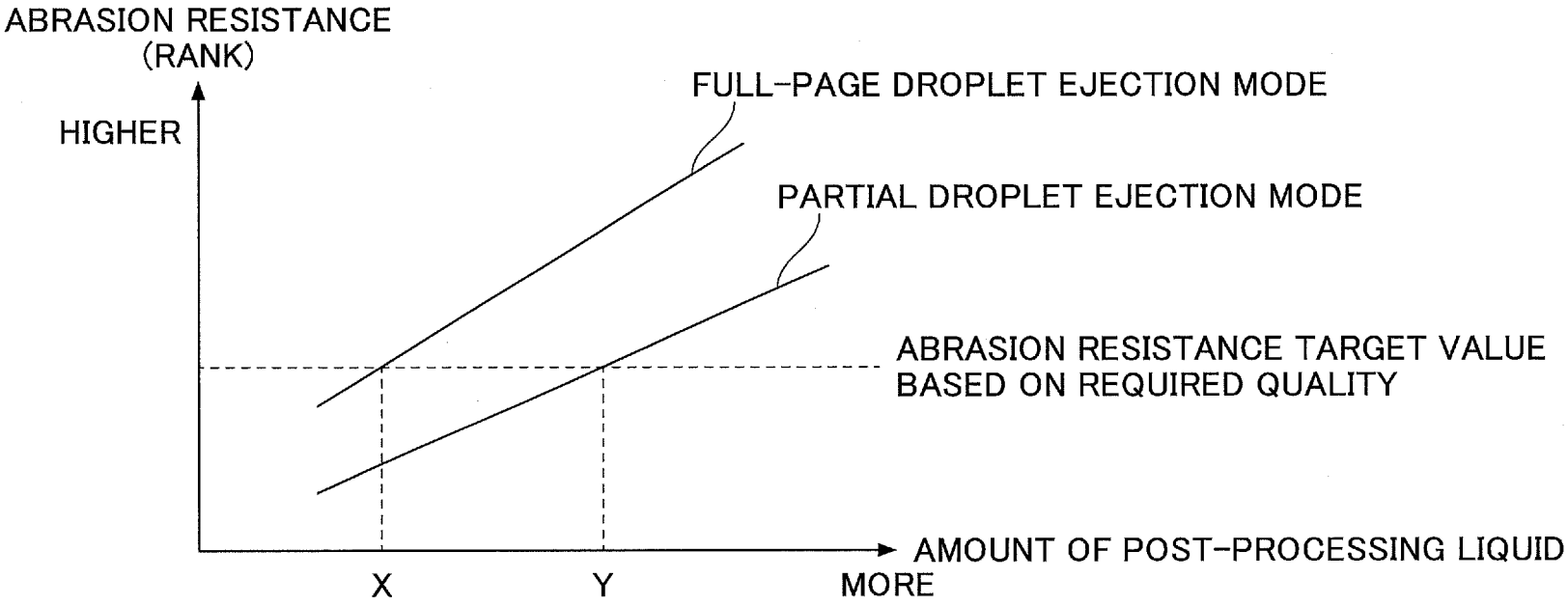
FIG. 11 is a graph representing a correlation between the amount of post-processing liquid and abrasion resistance.

(2) Prepare two types of rubbing paper, one "without post-processing" (simulating partial droplet ejection mode) and one "with post-processing" (simulating full-page droplet ejection mode), and perform predetermined abrasion resistance evaluation using the two types of rubbing paper. The result of performing the above abrasion resistance evaluation is represented by the graph of FIG. 11. The abrasion resistance evaluation may be made based on an evaluation of the fixation (spreading, scratch test) and temporal characteristics of the shear direction strength of the ink film, for example.

Note that in principle, the required amount of post-processing liquid may be determined based on the area on which droplets are to be ejected and the droplet density per unit area with reference to the abrasion resistance evaluation of FIG. 11.

FIG. 11 is a graph indicating the correlation between abrasion resistance and the amount of post-processing liquid obtained by performing the above abrasion resistance evaluation.

(3) Obtain the required amount of post-processing liquid X [mg/cm$^2$] for full-page droplet ejection mode and the required amount of post-processing liquid Y [mg/cm$^2$] for partial droplet ejection mode based on FIG. 11 (generally X is less than Y).

(4) Assuming S [cm$^2$] represents the reference area (e.g., area of print regions A-E of FIG. 10), and p (%) represents the coverage rate, a coverage rate $P_{TH}$ (%) for which the amount of post-processing liquid to be applied in the full-page droplet ejection mode and the amount of post-processing liquid to be applied in the partial droplet ejection mode will be equal is obtained as follows.

$$S\ [\mathrm{cm}^2]\times X\ [\mathrm{mg/cm}^2]=S\ [\mathrm{cm}^2]\,p_{TH}\ (\%)\times Y\ [\mathrm{mg/cm}^2]$$

$p_{TH}$ (%)=X/Y (≈ low droplet density over entire surface in full-page droplet ejection mode/high droplet density on printed portion in partial droplet ejection mode)

The above coverage rate $p_{TH}$ (%) may be set up as the predetermined threshold to be used for determining the droplet ejection mode to be implemented.

Note that the coverage rate $p_{TH}$ (%) may vary depending on the combination of the print medium type, the ink, and the post-processing liquid. For example, in a case where the print medium has a high friction coefficient, the difference in the abrasion resistance depending on whether the post-processing liquid is applied is widened, and as such, the value of X/Y (=pTH (%)) decreases.

As described above, if the coverage rate is low, "partial droplet ejection mode×high droplet density" is selected, and if the coverage rate is high, "full-page droplet ejection mode×low droplet density" is selected.

In this case, the determination of whether the coverage rate is high or low is made based on the above-mentioned threshold $p_{TH}$. The threshold $P_{TH}$ represents the coverage rate at which the amount of post-processing liquid to be applied in the partial droplet ejection mode will exceed the amount of post-processing liquid to be applied in the full-page droplet ejection mode.

The threshold $p_{TH}$ that has been obtained in the above-described manner may be stored in advance in a storage unit (e.g., memory unit 72EPm of FIG. 6). Thus, in an image forming operation, the coverage rate may be calculated based on the image data information, and the logic circuit 72EP1 may select the appropriate combination of the droplet ejection mode and the droplet amount (droplet density) per unit area for applying the post-processing liquid based on the calculated coverage rate and the threshold $p_{TH}$ stored in advance.

Also, in some embodiments, the friction coefficient of the print medium to be used and the resolution of the image to be formed may be used to further adjust the amount of post-processing liquid to be applied. For example, after either the "partial droplet ejection mode×high droplet density" or the "full-page droplet ejection mode×low droplet density" is selected, common adjustments to the post-processing liquid amount per unit area may be made based on the print medium type (e.g., friction coefficient) and the resolution of the image to be formed, irrespective of the droplet ejection mode that has been selected.

As described above, according to an aspect of the present embodiment, the coverage rate is calculated based on image data information, and the combination the droplet ejection mode and the droplet amount per unit area (droplet density) for applying the post-processing liquid is selected based on the calculated coverage rate. Specifically, if the coverage rate is high, "full-page droplet ejection mode×low droplet density" is selected, and if the coverage rate is low, "partial droplet ejection mode×high droplet density" is selected. In this way, the amount post-processing liquid applied may be reduced in both of the above cases, and problems relating to poor drying of the post-processing liquid and an increase in the cost per page may be avoided.

[Example Application]

In the following, an example application of the present invention is described. Note, however, that the present invention is not limited to the following example. The correlation represented by the graph in FIG. 11 may be obtained by assigning corresponding ranks to the abrasion resistance evaluation results obtained through experimentation. For example, the following Table 1 represents example evaluation results obtained for determining the threshold to be used for selecting the appropriate droplet ejection mode. In Table 1, the abrasion resistance is represented by a rank ranging from A to D, where A represents the highest rank and D represents the lowest rank.

TABLE 1

| | DROPLET MODE | | | | | |
|---|---|---|---|---|---|---|
| | FULL-PAGE | FULL-PAGE | FULL-PAGE | PARTIAL | PARTIAL | PARTIAL |
| PRINTING SPEED [m/min] | 30 | 30 | 30 | 30 | 30 | 30 |
| POST-PROCESSING LIQUID DEPOSITION AMOUNT (%) | 8 | 10 | 15 | 8 | 10 | 15 |
| ABRASION RESISTANCE RANK | C | B | A | D | C | B |

Note that in the above Table 1, the post-processing liquid deposition amount (%) may be determined based on "100%=maximum deposition amount that can be ejected (i.e., maximum droplet density per unit area)".

In the example of Table 1, it is assumed that ranks A and B for the abrasion resistance exceed an abrasion resistance target value (OK), and ranks C and D for the abrasion resistance are below the abrasion resistance target value (NG).

In the example of Table 1, the post-processing liquid was applied at the same post-processing liquid deposition amounts of 8%, 10%, and 15% in full-page droplet ejection mode and in partial droplet ejection mode. In this case, the total amount of post-processing liquid for full-page droplet ejection mode can be calculated as: "1 (entire print region)× low droplet density over entire surface", and the total amount of post-processing liquid for partial droplet ejection mode can be calculated as: "coverage rate p×high droplet density on printed portion". As can be appreciated, the abrasion resistance evaluations for full-page droplet ejection mode were ranked higher than the abrasion resistance evaluations for partial droplet ejection mode. FIG. 11 is a graph plotting the above evaluation results.

As indicated in Table 1, in the partial droplet ejection mode, when the post-processing liquid deposition amount is low and the droplet density per unit area is low, the abrasion resistance does not reach an acceptable rank. Accordingly, when the partial droplet ejection mode is implemented, the droplet density is set to a high density (at least 15% in the example of Table 1)

Also, in the full-page droplet ejection mode, when the post-processing liquid deposition amount is high and the droplet density per unit area is high, although the abrasion resistance may be improved, an unnecessarily large amount of the post-processing liquid may be used. Accordingly, when the full-page droplet ejection mode is implemented, the droplet density is preferably set to a density lower than that for the partial droplet ejection mode, but that still achieves an acceptable abrasion resistance rank above the target abrasion resistance value.

In the present example, based on the abrasion resistance evaluation results of FIG. 11 (assuming rank B is the target abrasion resistance value), the threshold $P_{TH}$ may be calculated as follows. $P_{TH}$=post-processing liquid deposition amount in full-page mode/post-processing liquid deposition amount in partial mode=10 (%)/15 (%)=⅔

Thus, in the present example, if the coverage rate of one page is less than or equal to 2/3, "partial droplet ejection mode×high droplet density (15%)" is preferably selected, and if the coverage rate is greater than ⅔, "full-page droplet ejection mode×low droplet density (10%)" is preferably selected.

Further, in some embodiments, when setting the threshold for selecting whether to implement the "partial droplet ejection mode×high droplet density" or the "full-page droplet ejection mode×low droplet density", and after selecting the droplet ejection mode, common adjustments may be made to the amount of post-processing liquid per unit area based on the type of print medium used and the resolution of the image to be formed as indicated in the following Table 2, for example.

TABLE 2

| | INCREASE POST-PROCESSING LIQUID AMOUNT | DECREASE POST-PROCESSING LIQUID AMOUNT |
|---|---|---|
| FRICTION COEFFICIENT | HIGH | LOW |
| RESOLUTION (DOT DIAMETER) | HIGH (SMALL) | LOW (LARGE) |

As indicated in the above Table 2, if the friction coefficient of the print medium is low, the required amount of post-processing liquid may be reduced.

Also, when the resolution is low, the required amount of post-processing liquid may be reduced. This is because the dot size is increased when the resolution is decreased such that dots formed print medium are less likely to peel off, for example.

Note that aspects of the present invention may be applied to a variety of apparatuses other than the inkjet image forming apparatus as described above. For example, the present invention may be applied to any apparatus, such as a printer, a scanner, a copier, a plotter, or a facsimile machine, that uses an ejector (ejecting head, ink head, recording head, inkjet head, etc.) to eject droplets of liquid (e.g., ink) to form (print, record, etc.) an image on the surface of a print medium (recording medium).

Also, in the above-described embodiments, the image forming apparatus 100 includes a conveying unit 10, a pre-processing liquid applying unit 20, a pre-processing liquid drying unit 31, an image forming unit 40, a post-processing liquid applying unit 50, a penetration unit 55, a post-processing liquid drying unit 32, and a discharge unit 60. However, the present invention is not limited to the above configuration. For example, one or more of the above units may be provided as a separate device (e.g. conveying device, pre-processing liquid application device, image forming device, post-processing liquid application device, penetration device, post-processing liquid drying device, and/or discharge device), and the present invention may be implemented by an image forming system including a combination of these devices. Also, the image forming system may include a superordinate apparatus to implement a control apparatus, for example.

Although the present invention has been described above with reference to certain illustrative embodiments, the present invention is not limited to these embodiments, and numerous variations and modifications may be made without departing from the scope of the present invention.

What is claimed is:

1. A post-processing liquid application device, comprising:

an ejecting head configured to eject a post-processing liquid in a specific ejection pattern on a recording medium after ink has been attached to the recording medium to form at least one of a character and an image generated based on image information on the recording medium; and a control unit configured to select the specific ejection pattern of the post-processing liquid to be ejected by the ejecting head from a plurality of ejection patterns based on a coverage rate calculated from the image information;

wherein, when the control unit determines that the coverage rate is low, the control unit selects, as the specific ejection pattern, a first ejection pattern for ejecting the post-processing liquid on a printed portion of a print region of the recording medium or ejecting the post-processing liquid on the printed portion and a surrounding portion of the printed portion to which the ink forming the at least one of the character and the image is attached; and wherein, when the control unit determines that the coverage rate is high, the control unit selects, as the specific ejection pattern, a second ejection pattern for ejecting the post-processing liquid over an entire surface of the print region of the recording medium.

2. The post-processing liquid application device according to claim 1, wherein when the coverage rate is determined to be low, and the post-processing liquid is to be ejected on the printed portion or the printed portion and the surrounding portion of the printed portion, the control unit increases a droplet density per unit area of the post-processing liquid to be ejected; and when the coverage rate is determined to be high, and the post-processing liquid is to be ejected over the entire surface of the print region of the recording medium, the control unit decreases the droplet density per unit area of the post-processing liquid to be ejected.

3. The post-processing liquid application device according to claim 2, further comprising:

a storage unit configured to store a correlation between the plurality of ejection patterns of the post-processing liquid to be ejected, the droplet density per unit area, and an abrasion resistance of the recording medium to which the post-processing liquid is applied;

wherein the control unit calculates a threshold of the coverage rate based on the stored correlation and compares the coverage rate calculated from the image information with the calculated threshold to determine whether the coverage rate is high or low.

4. The post-processing liquid application device according to claim 1, wherein one or more of the print regions are arranged in the recording medium; and the coverage rate is calculated with respect to each of the print regions within the recording medium.

5. The post-processing liquid application device according to claim 1, wherein when the control unit determines that a friction coefficient of the recording medium is high, the control unit increases a droplet density per unit area of the post-processing liquid to be ejected.

6. The post-processing liquid application device according to claim 1, wherein when the control unit determines that a friction coefficient of the recording medium is low, the control unit decreases a droplet density per unit area of the post-processing liquid to be ejected.

7. The post-processing liquid application device according to claim 1, wherein when the control unit determines that a resolution of an image to be formed is low, the control unit decreases a droplet density per unit area of the post-processing liquid to be ejected.

8. The post-processing liquid application device according to claim 1, wherein when the control unit determines that a resolution of an image to be formed is high, the control unit increases a droplet density per unit area of the post-processing liquid to be ejected.

9. A post-processing liquid application method to be implemented by the post-processing liquid application device according to claim 1, the post-processing liquid application method comprising steps of:

calculating the coverage rate based on the image information;

selecting the specific ejection pattern of the post-processing liquid to be ejected; and ejecting the post-processing liquid in the selected specific ejection pattern on the recording medium on which the at least one of the character and the image is formed;

wherein when the coverage rate is determined to be low, the first ejection pattern is selected for ejecting the post-processing liquid on the printed portion of the print region of the recording medium or ejecting the post-processing liquid on the printed portion and a surrounding portion of the printed portion to which the ink forming the at least one of the character and the image is attached; and wherein when the coverage rate is determined to be high, the second ejection pattern is selected for ejecting the post-processing liquid over the entire surface of the print region of the recording medium.

10. A non-transitory computer-readable medium storing a program that, when executed, causes the post-processing liquid application device according to claim 1 to perform a post-processing liquid application method comprising steps of:

calculating the coverage rate based on the image information;

selecting the specific ejection pattern of the post-processing liquid to be ejected; and ejecting the post-processing liquid in the selected specific ejection pattern on the recording medium on which the at least one of the character and the image is formed;

wherein when the coverage rate is determined to be low, the first ejection pattern is selected for ejecting the post-processing liquid on the printed portion of the print region of the recording medium or ejecting the post-processing liquid on the printed portion and a surrounding portion of the printed portion to which the ink forming the at least one of the character and the image is attached; and wherein when the coverage rate is determined to be high, the second ejection pattern is selected for ejecting the post-processing liquid over the entire surface of the print region of the recording medium.

11. An image forming system comprising:

an image forming device configured to form at least one of a character and an image on a recording medium, based on image information, by attaching ink to the recording medium;

a computing unit configured to calculate a coverage rate based on the image information; and a post-processing liquid application device configured to eject a post-processing liquid on the recording medium on which the at least one of the character and the image is formed;

wherein the post-processing liquid application device includes a control unit configured to select an ejection pattern of the post-processing liquid to be ejected from a first ejection pattern and a second ejection pattern; and an ejecting unit configured to eject the post-processing liquid in the selected ejection pattern on the recording medium on which the at least one of the character and the image is formed;

wherein when the control unit determines that the coverage rate is low, the control unit selects the first ejection pattern, which is for ejecting the post-processing liquid on a printed portion of a print region of the recording medium or ejecting the post-processing liquid on the printed portion and a surrounding portion of the printed portion to which the ink forming the at least one of the character and the image is attached; and wherein when the control unit determines that the coverage rate is high, the control unit selects the second ejection pattern, which is for ejecting the post-processing liquid over an entire surface of the print region of the recording medium.

* * * * *